US010825676B2

(12) United States Patent
Jiang et al.

(10) Patent No.: US 10,825,676 B2
(45) Date of Patent: Nov. 3, 2020

(54) QUADRUPOLE MASS ANALYZER AND METHOD OF MASS ANALYSIS

(71) Applicant: SHIMADZU CORPORATION, Kyoto (JP)

(72) Inventors: Gongyu Jiang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/512,812

(22) Filed: Jul. 16, 2019

(65) Prior Publication Data

US 2020/0027714 A1 Jan. 23, 2020

(30) Foreign Application Priority Data

Jul. 17, 2018 (CN) ..... 2018 1 0781345

(51) Int. Cl.
*H01J 49/42* (2006.01)
*H01J 49/06* (2006.01)

(52) U.S. Cl.
CPC ..... *H01J 49/426* (2013.01); *H01J 49/062* (2013.01)

(58) Field of Classification Search
None
See application file for complete search history.

(56) References Cited

U.S. PATENT DOCUMENTS 2,939,952 A 12/1954 Pual et al.
5,089,703 A 2/1992 Schoen et al.
5,227,629 A 7/1993 Miseki
2002/0005479 A1* 1/2002 Yoshinari ..... H01J 49/424 250/288

(Continued)

FOREIGN PATENT DOCUMENTS

CN 105957797 A 9/2016

OTHER PUBLICATIONS

Amad, Ma'An H., et al., "High-Resolution Mass Spectrometry with a Multiple Pass Quadrupole Mass Analyzer", Anal. Chem. 1998, pp. 4885-4889, vol. 70 No. 23.

(Continued)

*Primary Examiner* — Andrew Smyth
(74) *Attorney, Agent, or Firm* — Tim Tingkang Xia, Esq.; Locke Lord LLP

(57) ABSTRACT

A quadrupole mass analyzer according to the present invention optimizes a stability band formation mode of a quadrupole system, so as to facilitate passing of ions and blocking of excessive ions, thereby improving the mass resolution without reducing the ion transmission efficiency. The solution of the present invention avoids the superimposition of high-frequency AC signals needed in the ion two-direction resonance frequency control in the prior art, and can effectively reduce the risk of quadrupole working performance reduction caused by the non-linear distortion of an RF voltage caused by bandwidth limitation in a fast RF circuit. In addition, a scanning speed of an ion-controlled electric (Continued)

field required by the quadrupole mass spectrometry can also be controlled faster because of reduction of limit bandwidth of various needed AC excitation signals. It is advantageous to obtain high-speed quadrupole scanning mass spectrometry performance.

11 Claims, 24 Drawing Sheets

(56) References Cited

U.S. PATENT DOCUMENTS

2004/0232328 A1* 11/2004 Ding ..... H01J 49/0068 250/292
2006/0219933 A1* 10/2006 Wang ..... H01J 49/421 250/396 R
2008/0217527 A1* 9/2008 Wang ..... H01J 49/426 250/282
2010/0237237 A1* 9/2010 Green ..... H01J 49/427 250/283
2012/0280123 A1* 11/2012 Kenny ..... H01J 49/422 250/290
2014/0131569 A1* 5/2014 Guna ..... H01J 49/4265 250/284
2018/0342382 A1* 11/2018 Cooks ..... H01J 49/429

OTHER PUBLICATIONS

Brubaker, W. M., et al., "Ion Source for Magnetic Mass Spectrometer to be Used in Space", The Journal of Vacuum Science and Technology, 1971, pp. 273-274, vol. 8, No. 1.
Chen, Wei et al., "Hi-Resolution Mass Spectrometry with a Quadrupole Operated in the Fourth Stability Region", Analytical Chemistry, 2000, pp. 540-545, vol. 72, No. 3.
Konenkov, N.V., et al., "Quadrupole mass filter operation with auxiliary quadrupolar excitation: theory and experiment", International Journal of Mass Spectrometry 2001, pp. 17-27, vol. 208.
Dawson, Peter H., "Quadrupole Mass Spectrometery and Its Applications", American Institute of Physics, 1976.
Rettinghaus, G., et al., "A Simple Quadrupole Residual Gas Analyzer", Journal of Vacuum Science & Technology, 1971, p. 272, vol. 8, No. 1.
Sudakov, M. Yu. et al., "The Use of Stability Bands to Improve the performance of Quadrupole Mass Filters", Technical Physics, 2017, pp. 107-115, vol. 67, No. 1.
Von Zahn, U., et al., "Prazision-Massenbestimmungen mit dem elektrischen Massenfilter", Z. Phys. 1962, pp. 129-142, vol. 168.
Zhao, Xianzhen et al., "Overcoming Field Imperfections of Quadrupole Mass Filters with Mass Analysis in Islands of Stability", Analytical Chemistry, 2009, pp. 5806-5811, vol. 81, No. 14.
Konenkov, N.V. et al., "Matrix Method for the Calculation of Stability Diagrams in Quadrupole Mass Spectrometry", J AM Soc Mass Spectrom, 2002, pp. 597-613, vol. 13.
Jiang, Gongyu, "Development of Novel Quadrupole Mass Analyzer", Doctoral Thesis, Fudan University, Nov. 13, 2011.

* cited by examiner

QUADRUPOLE MASS ANALYZER AND METHOD OF MASS ANALYSIS

CROSS-REFERENCE TO RELATED APPLICATION

This application claims priority to and the benefit of Chinese Patent Application No. 201810781345.3, filed Jul. 17, 2018 in the State Intellectual Property Office of P.R. China, which is hereby incorporated herein in its entirety by reference.

FIELD OF THE INVENTION

The present invention relates generally to the field of mass analysis, and more particularly, to a quadrupole mass analyzer and a method of mass analysis.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

Quadrupole mass analyzer is the most widely used mass spectrometry analyzer system at present. Its prototype was produced in the 1950s and was a very mature technology and method invented by Nobel Prize winner Paul et al. For example, in the original U.S. Pat. No. 2,939,952, four hyperbolic or circular rod electrodes are symmetrically placed in parallel with an ion optical system, two electrode rods which are relatively symmetric in them are respectively connected in pairs, and the quadrupole DC voltage and RF voltage with outputs which are phase-opposite to each other are applied to them. A time-dependent alternating voltage of $V(t)=+(U+V\cos\Omega t)$ is applied to one pair of electrodes, while a reverse alternating voltage of $-V(t)=-(U+V\cos\Omega t)$ is applied to the other pair of electrodes, where U represents DC voltage, V is AC voltage, and Ω is angular frequency of RF power supply. When the ratio of the configured quadrupole RF voltage to the quadrupole DC voltage is appropriate, ions with specific mass-charge ratio Mz can stably pass through the quadrupole system, ions with mass-charge ratio smaller than this value tend to be lost on one pair of electrodes, and ions with mass-charge ratio greater than this value tend to be lost on the other pair of electrodes. Under this working mode, the quadrupole system can be regarded as a filter capable selectively filtering ions with a specific mass and thus is also referred to as a quadrupole mass filter.

For ions with a mass of 1 to 100,000 usually analyzed by a mass spectrometry system, it is appropriate to use an RF voltage with a working frequency of 0.2 to 10 MHz as the AC voltage mentioned above. Usually the ion energy implanted into the quadrupole mass filter is several to tens of electron volts. When ions pass through a quadrupole with a length of several hundred millimeters, they will undergo approximately tens to hundreds of RF periods. Under the effect of the RF voltage, the ions oscillate periodically in respective direction of two pairs of poles, and the stability of the motion determines the mass-charge ratio range of the transmitted ions. Generally, the quadrupole and the used power supply should make the electric field generated in the central region of the quadrupole as close as possible to the distribution of a pure quadrupole electric field, as expressed by the following equation:

$$\Phi(x, y, z, t) = V(t) \cdot \frac{x^2 - y^2}{r_0^2} \tag{1}$$

where $r_0$ is the minimum distance from the surface of the quadrupole to the central symmetry axis, also known as the electric field radius of the quadrupole rod electrode system. The situation of force acting on ions in the quadrupole system can be determined by the differential equation of the electric field. For a pure quadrupole field, the motion of ions in X and Y directions is not correlated. The two following important dimensionless parameters can be obtained by resolving the Newtonian motion equation-Mathieu equation of ions:

$$a = \frac{8eU}{M\Omega^2 r_0^2} \text{ and } q = \frac{4eV}{M\Omega^2 r_0^2} \tag{2}$$

where M and e respectively represent ion quota mass and charge.

The working process of the quadrupole mass analyzer includes the following steps:

enabling ions produced by an ion source to enter a quadrupole mass analysis system along an axis of a quadrupole;

loading an RF power supply with components AC V and DC U to quadrupole rod electrodes;

maintaining the ratio of DC U to AC V to be slightly lower than $\lambda_1=a_1/2q_1=0.167852$; and gradually increasing the values of U and V, maintaining the ratio unchanged, and determining ions passing through the quadrupole rod electrode system.

The relationship between the ion signal intensity and the corresponding RF voltage V is recorded. According to the following equation (3), the required mass spectrogram can be obtained.

$$M_{nom} = \frac{4e}{\Omega^2 r_0^2} \cdot \frac{V}{q_1} \tag{3}$$

FIG. 1 is a schematic structural diagram of a conventional quadrupole rod electrode system and a schematic diagram of the power supply connection mode thereof.

Mathieu equation describes the complex motion trajectories of ions in the quadrupole field, which can be divided into stable and instable motion trajectories. The stable motion of ions in the quadrupole system refers to that the motion radius range of the ions is smaller than the field radius ($r_0$) of the quadrupole rod electrode system, that is to say, the motion of ions in the whole quadrupole electrode system will not cause them to touch the quadrupole and disappear. The stability or instability of ions in the quadrupole field can be expressed in a two-dimensional "stability diagram" taking a, q as coordinates. The stable motion of ions refers to that the motion of ions in X and Y directions is stable. Mathematically, ions may have many stability regions. The most commonly used stability region is a first stability region, as shown in FIG. 2.

In practical work, ions with different mass-charge ratios entering the quadrupole are all distributed on the same scanning line $a=2\lambda q$ in a, q space. Ions with a smaller mass have a larger q value, while larger ions are located on the side of the scanning line near the origin. Slope $\lambda=U/V$ is not related to ion mass, but its magnitude determines the width of the mass filter window formed by overlapping with the stability region. The vertex coordinates of the first stability region of an ideal quadrupole field system are located at $a_1=0.236994$ and $q_1=0.705996$.

When the quadrupole mass analyzer performs mass analysis, it is necessary to enable the scanning line to sweep a position slightly below the vertex (as shown in FIG. 2). In this case, q values corresponding to ions only with a mass range, e.g., from $M_{low}$ to $M_{high}$, correspond to regions where motions are stable in both X and Y directions. The mass resolution of the quadrupole mass analyzer is shown in equation (3):

$$R = \frac{M}{\Delta M_{10\%}} \tag{3}$$

R is the resolution at a mass, M is the peak mass-charge ratio of mass spectrum, and the peak width ΔM is the width at a relative ratio height, such as 10% peak height or 50% peak height. In theory, the mass resolution can be obtained directly from q according to equation (4), i.e.

$$R=q_1/\Delta q \tag{4}$$

where $\Delta q=q_{max}-q_{min}$ represents the direct distance between to two intersections of the scanning line and the stability region. Accordingly, we can deduce the theoretical resolution of the actual quadrupole mass filter system from the boundary curve of the stability diagram. It needs be noted that the theoretical resolution is correct only when the ions have run for a long enough time in the quadrupole rod electrode system.

Referring to the conclusion made by Dawson P. H. in his book Quadrupole Mass Spectrometry and its Applications, American Institute of Physics, Woodbury, N.Y., [1995]. Since the motion time of ions in the quadrupole rod electrode system is always limited, if the period number n of motion of ions in the quadrupole rod electrode system is used for expression, the obtained maximum mass resolution has a square relationship with the period number, i.e., Zahn's theorem:

$$R_{max} = \frac{n^2}{C} \tag{5}$$

where C is a constant related to the calculation of mass resolution at a mass spectrum peak height. For example, when the mass resolution is measured at a 10% peak height, $C\approx 20$.

Equation (5) gives the mass resolution capable of being obtained under the situation that the quadrupole operates normally. For example, the maximum mass resolution capable of being obtained under the situation that an ion operates for 100 RF periods is approximately 500. This is the reason why commercial quadrupole mass spectrometers usually work at unit mass resolution.

With the development of modern mass spectrometry technology, the need for higher resolution in many applications has been discovered. For example, a large number of high-charge isotope peaks need to be resolved in bio-mass spectrometry. In element analysis, the loss of mass-charge ratio of elements due to binding energy in the core can also be used to resolve isotope information of different elements with the same unit mass. These requirements require a mass analyzer to resolve ions with a mass-charge ratio difference of 0.2, 0.1 or even 0.01. Usually, it is very difficult for the existing quadrupole mass spectrometers to meet such analytical requirements.

At present, scientific and technical personnel have tried many ways to improve the resolution of the quadrupole mass filter system. First, an elongated quadrupole system is used. For example, U. Von Zahn, et al., ever manufactured a quadrupole with length of 5.8 m to obtain R=16,000 resolution (refer to Z. Phys. 168, 129-142 (1962)). However, this method is limited by the processing accuracy and assembling accuracy of the processed electrodes in practical production. At present, the length of the quadrupole with an electric field radius of 4 mm to 6 mm is generally 150 mm to 300 mm. For a longer quadrupole system, it is very difficult to control the parallel relationship and the inner field radius to be below a micron level. Even if the above accuracy is achieved at any cost, the actual resolution of the system will be much lower than the preset accuracy due to the sag of the cantilever beam formed by the dead weight of the system. In addition, the kinetic energy of ions implanted into the quadrupole system can also be controlled and reduced. However, due to the characteristics of Liouville's theorem in the ionic phase space, the reduction of the kinetic energy of ions will inevitably be accompanied by the broadening of the ionic radial position-momentum area, thus greatly reducing the ion transmission efficiency. At the same time, the increase of the residence time caused by the decrease of the kinetic energy of ions will severely limit the scanning speed of the quadrupole mass filter. This is unacceptable for modern mass spectrometry systems required to execute intensity analysis of hundreds of ion pairs per second.

For this reason, scientists have also proposed other methods to improve the resolution of the quadrupole. For example, M. H. Amad, et al. tried to apply reflection lens groups at the front and rear of the quadrupole to increase the effective length of the quadrupole in the American Journal of Analytical Chemistry, and obtained a mass resolution of approximately 22,000. However, this method seriously reduces the effective duty cycle time of the mass analysis system, and the peak shape of mass spectrum is also unsatisfactory.

In addition, scientists also tried to use other stability regions. As shown in FIG. 3, stability islands (grey) affected by a single AC excitation voltage with a frequency of 0.95 are illustrated. The main stability islands are marked as A, B and C. Thick and solid lines mark the boundary of the first stability region, and the slope of the scanning line (thin and solid lines) is $\lambda=0.168$.

In the fourth stability region with a q value of approximately 21, the Zahn constant C value is smaller than that of the first stability region which is commonly used. DJ Douglas, et al., have obtained a resolution of approximately 13,000. However, using such a high-order stability region with a high q value to form an analysis window will greatly increase the required RF power supply voltage, so it can only be applied to mass spectrum analysis of a small amount of elements with a low atomic weight.

Reducing the magnitude of the Zahn coefficient C can greatly improve the performance of the quadrupole mass analyzer. In addition to using the high-order stability region, another method to reduce the constant C is to use the so-called AC excitation mode. The principle is to use an AC electric field with frequency different from the frequency of the main RF voltage, so that its frequency is kept the same as the long-term oscillation frequency of ions in X or Y directions in the quadrupole field or is kept to have an integral-ratio frequency relationship with it, so that the vibration amplitude excitation of ions is sharpened and the trajectory stability of ions in a critical state is clarified. Alan Schoen (refer to U.S. Pat. No. 5,089,703) in 1992 and Kozo Miseki (refer to U.S. Pat. No. 5,227,629) in 1993 proposed similar solutions to improve the resolution of the quadrupole mass spectrometry, where Alan's solution is to use two different AC spaces to polarize the excitation voltage to enable the vibration amplitudes of ions in X and Y directions to periodically change when the phases coincide with each other or are different, so as to obtain the spectrum peaks of the front and rear edge undulation of the peaks, and then use a mathematical algorithm for deconvolution to obtain a high resolution. This method was later developed in 2013 to use a high-speed space-resolved surface detector to measure the characteristics of emitted ions in phase space. The deconvolution efficiency is further improved by introducing more dimension information (emission space distribution, phase time distribution), and a resolution of approximately 50,000 can be obtained. However, it needs to be pointed out that the high resolution which uses the phase information of discrete ion flows and is deconvoluted requires a large amount of statistical data of ions for subsequent deconvolution operation. A single ion cannot obtain such high resolution, so its application in high-sensitivity quadrupole mass spectrometers is restricted.

The principle of the excitation quadrupole mass analyzer invented by Kozo Miseki et al. is based on another way. In addition to the normal DC and RF voltages, a very small AC voltage $V_{ex}$ Cos $\omega_{ex}t$ (AC excitation voltage) is applied to the quadrupole. Unlike the RF frequency which is $\Omega$, the frequency of the AC excitation voltage is $\omega_{ex}$, correspondingly an instability band is generated near the vertex of the stability region, and the top end of the initial first stability diagram is split into many stability island structures, as shown in FIG. 4. By using the structures of the stability islands, a sharpened quadrupole mass spectrometry stability window can be obtained. Unlike Alan's solution, the instantaneous electric field excited by the quadrupole is the same quadrupole field structure as that of the RF voltage field, thus avoiding the field imperfection introduced by the dipole polarized electric field. At this moment, the formed stability island structure only is very slightly phase-dependent and space-dependent, and clear spectrum peak front and rear boundaries can be formed. For example, in the gas chromatography-mass spectrometer of Shimadzu Corporation, ions are enabled to pass through the position of the stability island A, the peak shape is effectively optimized, and the mass resolution and measurement reliability are improved. However, it needs to be pointed out that, in actual application, the magnitude of the quadrupole excitation voltage needs to be limited due to the simultaneous excitation of ions in the X and Y directions. Moreover, due to the truncation of the size of the actual quadrupole system, the ion motion in the X-Y direction will inevitably be accompanied by certain coupling. Especially in the island A at the top end of the first stability diagram, the ion motion amplitude in the X and Y directions is very large, and the coupling terms will cause serious passivation of the tip end of the stability diagram. Therefore, in fact the improvement of the mass resolution of this method will be limited to approximately 0.1 unit half-height peak width.

Russian scientists have systematically studied the problem about a single-quadrupole excitation voltage. For example, as shown in the article published by Konenkov N. V, Cousins L. M., Baranov V. I., Sudakov M. Yu et al. in Int. J. Mass Spectrom., 2001, v. 208, p. 17-27, in islands B and C slightly at the lower part of FIG. 4, since ion vibration in only one direction is affected by quadrupole excitation (e.g., while passing through the island B, the stability of ions in the Y direction has a narrow window, which is stable in the X direction, and while passing through the island C, on the contrary, the Y motion is maintained stable on both sides of the stability island, and a narrow passage window appears in the X direction), and comparatively, the best separation effect can be obtained in the stability island C. However, using a single AC excitation voltage has the disadvantage that, when the scanning line passes through the stability island C, it also passes through the stability island B, or vice versa, it will produce ghost peaks, so that this characteristic cannot be effectively used.

Some solutions to this problem are based on the combination of quadrupole systems. For example, two sections of short quadrupoles connected in series may be used, quadrupole excitation is applied to one section, while no quadrupole excitation is applied to the other section or the applying mode is changed, such as through direct superimposition coupling, phase modulation and amplitude modulation to obtain the change of the position of the stability island. For example, in the doctoral thesis "Development of Novel Quadrupole Mass Analyzer" of Jiang Gongyu et al., the q value range of the island B of the first section is enabled to fall within the instability band formed by the second section, thus eliminating the ghost peaks when the mass resolution is obtained through the island C. The experimental results presented in this paper indicate that the instrument designer can obtain the unit mass resolution at 502 u on a sectional quadrupole circular rod with a total length of only 40 mm. Considering the passivation of the tip end of the stability diagram of the circular rod itself and the influence of the edge field at the front and rear of the short rod length itself, and considering that this resolution requires a quadrupole length of 100 mm or more under normal circumstances, this experimental result itself has proved the advantage of using the island C or similar position to obtain the mass resolution, and the Zahn coefficient C of the quadrupole mass filter can be effectively reduced. However, this method needs double the length of the quadrupole mass filter to eliminate the existence of the island B when the high resolution is obtained, and the advantage in actual manufacturing is not great.

Chinese patent application (201610381240.X) provided by Sudakov M. Yu. et al. in corporation with Fudan University discloses overcoming this problem by using two AC excitation voltages. The equation containing DC, RF and two AC excitation voltages is in compliance with $V(t)=U+V \cos \Omega t+V_{ex1} \cos(\omega_{ex1}t+\alpha_1)+V_{ex2} \cos(\omega_{ex2}t+\alpha_2)$ where $\Omega$ is the an RF frequency, $\omega_{ex1}$ and $\omega_{ex2}$ are the frequency of two AC excitation voltages, and it is defined that $\omega_{ex1}<\omega_{ex2}$; $V_{ex1}$ and $V_{ex2}$ are respectively the amplitudes of the first AC excitation voltage and the second AC excitation voltage, and $\alpha_1$ and $\alpha_2$ are the initial phases of RF. Considering the infinitely-small time variable $\xi=\Omega t/2$, the transverse motion equation of ions is as follows:

$$\frac{d^2x}{d\xi^2}+[a+2q\mathrm{Cos}2\xi+2q_{ex1}\mathrm{Cos}(2v_1\xi+\alpha_1)+2q_{ex2}\mathrm{Cos}(2v_2\xi+\alpha_2)]\cdot x=0 \quad (5.a)$$

$$\frac{d^2y}{d\xi^2}-[a+2q\mathrm{Cos}2\xi+2q_{ex1}\mathrm{Cos}(2v_1\xi+\alpha_1)+2q_{ex2}\mathrm{Cos}(2v_2\xi+\alpha_2)]\cdot y=0 \quad (5.b)$$

The application of two AC excitation voltages demonstrates new performance. By selecting the appropriate excitation frequencies $\omega_{ex1}$ and $\omega_{ex2}$, and amplitudes $V_{ex1}$ and $V_{ex2}$, the instable motion regions in the X or Y direction are offset, and the boundary of the corresponding stability region is maintained unchanged, while the other parts are split. A long strip stability band also appears above the stability region. The structure of this stability band is related to the ratio of the two applied RF voltages. For example, when the two quadrupole excitation frequency coefficients are respectively $v_1=0.05$, $v_2=0.95$, i.e., when the frequency is respectively 1/20 and 19/20 of the frequency of the RF voltage, and the amplitude ratio is selected to be $V_{ex1}/V_{ex2}=1/2.94$, the motion amplitude excitation of ions in the Y direction will be suppressed. As it can be learned from the drawing, a long and narrow stability band appears on the right side of the initial stability region, which is referred to as "X motion stability band".

FIGS. 4A and 4B are stability diagrams near vertexes when an AC excitation frequency is 0.05 and 0.95, where stable motion regions are represented by grey, thick black lines represent boundaries of initial stability regions, and scanning lines pass through the vertexes of the stability regions: $\lambda=a_1/2q_1=0.167852$. FIG. 4A represents a situation that the excitation voltages are in the same phase and FIG. 4B represents an inversion that the excitation voltages are in reverse phase.

In addition, the frequency of the AC excitation voltage is the same as that of FIG. 4A, but the phase is reverse ($q_{ex2}$ is negative). As shown in FIG. 4B, at this moment, X motion is not affected. As a result, a long and narrow stability band appears on the left side of the initial stability region, which is referred to as "Y motion stability band". When the ion motion is selected through the stability region, the ghost peaks formed by the scanning line simultaneously passing through the initial main stability region can be avoided.

It needs to be pointed out that the existing quadrupole mass spectrometry system still has many limitations in the working mode of obtaining a high resolution, such as the need for multiple ion events to be processed by adopting a statistical algorithm to achieve the resolution, or the dependence on multiple phase-and-frequency-locked precise RF voltages to form a special stable diagram structure to obtain a resolution effect. Because of the limitation of the equivalent sampling principle, when more than one AC voltage is used to excite ions, the sampling time precision of voltage waveform generation is required to reach at least the least common multiple of each AC voltage period, so that the initial stability diagram structure is not effectively destroyed. Because the frequency of the main RF voltage has reached an MHz level, to obtain the effective characteristics of multiple AC waveforms, the voltage precision is required to satisfy at least 18 bits or higher resolution demand, and the sampling rate of the digital-analog converter is required to be higher than 20 MHz, which is relatively disadvantageous to the actual circuit implementation of the high-resolution mass spectrometry system. Therefore, it is necessary to develop a new quadrupole mass analyzer with a high resolution.

SUMMARY OF THE INVENTION

In view of the disadvantages in the prior art described above, the purpose of the present invention is to provide a quadrupole mass analyzer and a mass analysis method to resolve the problems in the prior art.

To realize the above purpose and other related purposes, the present invention provides a quadrupole mass analyzer, including: a first pair of rod electrodes placed in a first plane along an axis direction; a second pair of rod electrodes placed in a second plane along the axis direction, the second plane being perpendicular to the first plane so that the first pair of rod electrodes and the second pair of rod electrodes form a quadrupole; a DC power supply used for providing a DC potential difference U between the two pairs of rod electrodes; an RF power supply used for providing an RF voltage between the two pairs of rod electrodes, an amplitude of the RF voltage being U and a frequency being $\Omega$; a first AC frequency source used for driving a first AC excitation voltage between the two pairs of rod electrodes, an amplitude of the first AC excitation voltage being smaller than the amplitude V of the RF voltage and being recorded as $V_{ex1}$, a frequency of the first AC frequency source being $\omega_{ex1}$ different from $\Omega$; a second AC frequency source used for linearly modulating the amplitude V of the RF voltage, a modulation frequency being $\omega_{ex2}$.

In one embodiment, $\omega_{ex1}$ is equal to $\omega_{ex2}$.

In one embodiment, $\omega_{ex1}$ is twice $\omega_{ex2}$.

In one embodiment, $V_{ex1}/V$ is in a range of 0.001 to 0.02.

In one embodiment, $\Omega/\omega_{ex1}$ is an integer greater than or equal to 5.

In one embodiment, a modulation depth of the second AC frequency source to the RF voltage provided by the RF power supply is in a range of 90% to 110%.

In one embodiment, a modulation depth of the second AC frequency source to the RF voltage provided by the RF power supply maintains a linear relationship with an amplitude $V_{ex1}$ of an excitation voltage generated by the first AC frequency source.

In one embodiment, the quadrupole mass analyzer includes a third AC frequency source used for driving a second AC excitation voltage between two pairs of rod electrodes, an amplitude of the second AC excitation voltage is smaller than the amplitude V of the RF power supply and is recorded as $V_{ex3}$, and the frequency $\omega_{ex3}$ is different from $\Omega$.

In one embodiment, $\omega_{ex3}$ is equal to a positive value of $\omega_{ex1}+B\Omega$, where A is a non-zero integer between −3 and 3, and B is a non-negative integer.

In one embodiment, a ratio of U to V is in a range of 0.167 to 0.172.

To realize the above purpose and other related purposes, the present invention provides a mass analysis method, which is applied to the quadrupole mass analyzer and includes: guiding ions to enter the quadrupole mass analyzer along an axis direction, where in the quadrupole mass analyzer, the RF power supply applies an RF voltage with the amplitude of V and the frequency of $\Omega$ between the two pairs of rod electrodes, and the DC power supply applies the DC potential difference U between the two pairs of rod electrodes; the first AC frequency source applies the first AC excitation voltage with the amplitude of $V_{ex1}$ and the frequency of $\omega_{ex1}$ between the two pairs of rod electrodes, and the first AC excitation voltage is superimposed on the RF voltage; the second AC frequency source generates a modulation signal with a modulation frequency of $\omega_{ex2}$, and modulates the amplitude V of the RF voltage by using the signal; maintaining a specific ratio among the amplitude of the RF voltage, the voltage amplitude of the first AC frequency source and the modulation amplitude of the second AC frequency source, so that the AC frequency sources are phase-coherent; and regulating the amplitude of the RF voltage to collect ions.

As described above, the quadrupole mass analyzer according to the present invention optimizes the stability band formation mode of the quadrupole system, so as to facilitate passing of ions and blocking of excessive ions, thereby improving the mass resolution without reducing the ion transmission efficiency. The solution of the present invention avoids the superimposition of high-frequency AC signals needed in the ion two-direction resonance frequency control in the prior art, and can effectively reduce the risk of quadrupole working performance reduction caused by the non-linear distortion of the RF voltage caused by bandwidth limitation in a fast RF circuit. At the same time, the scanning speed of an ion-controlled electric field required by the quadrupole mass spectrometry can also be controlled faster because of the reduction of the limit bandwidth of various needed AC excitation signals. It is advantageous to obtain high-speed quadrupole scanning mass spectrometry performance.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The following drawings form part of the present specification and are included to further demonstrate certain aspects of the invention. The invention may be better understood by reference to one or more of these drawings in combination with the detailed description of specific embodiments presented herein. The drawings described below are for illustration purposes only. The drawings are not intended to limit the scope of the present teachings in any way.

DETAILED DESCRIPTION OF THE INVENTION

Figure 1:
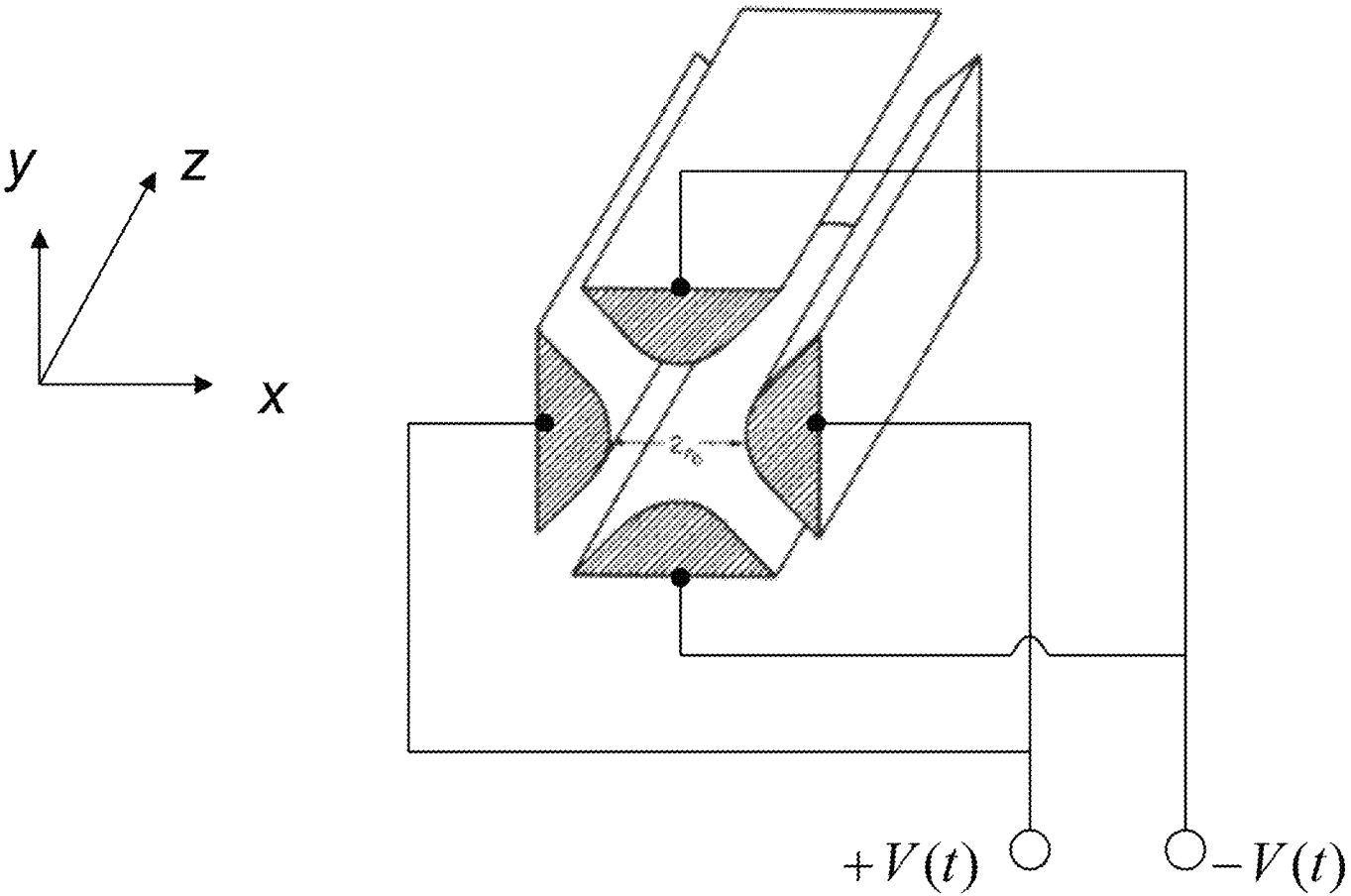
FIG. 1 is a schematic structural diagram of a quadrupole and an application power supply in the background.
Figure 2:
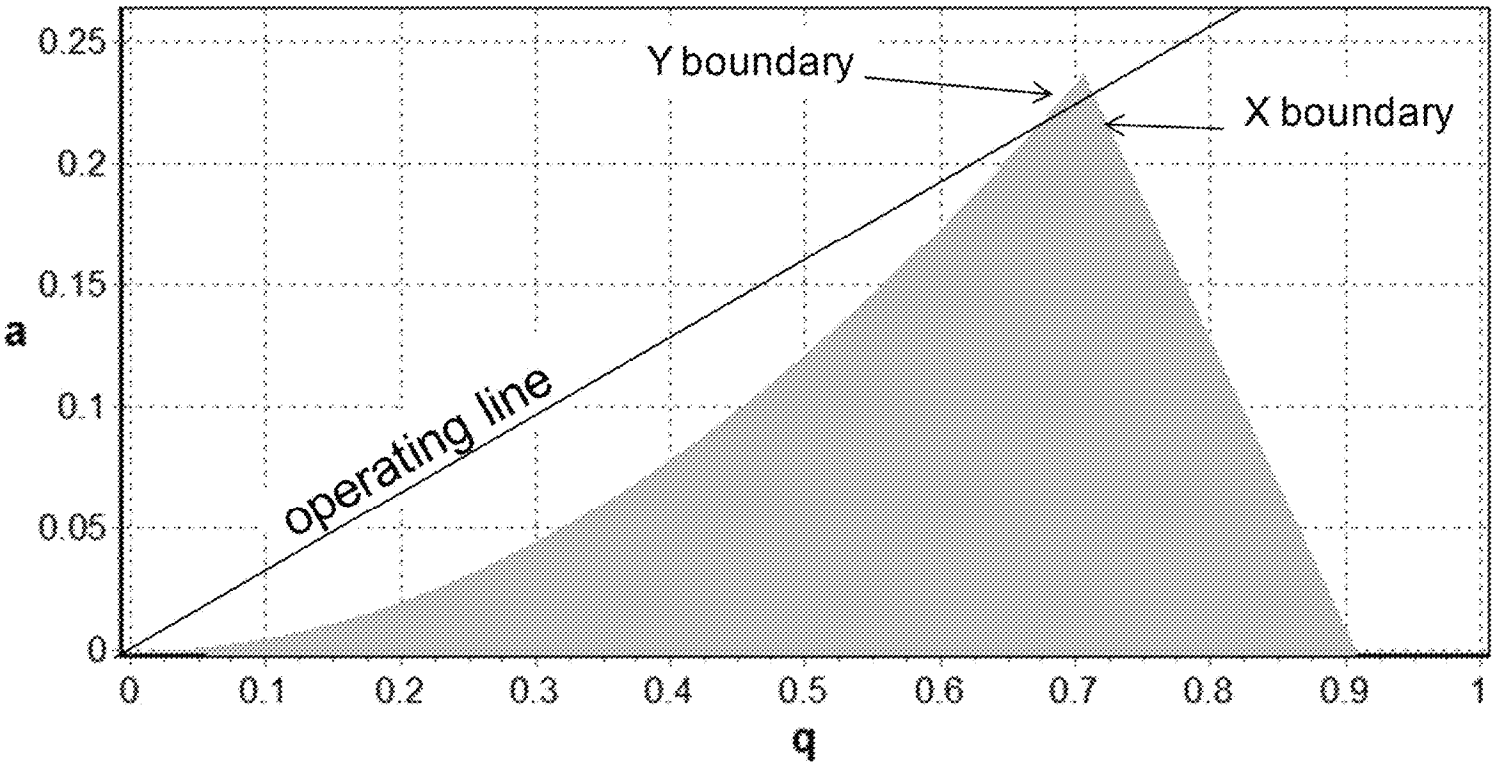
FIG. 2 is a general diagram of a mass filter in the background, where a first common stability region (grey) shows the position of an operating line below the tip end of a stability line, and the stability region is formed by stability boundaries of Y and X motions marked on the drawing.

Implementations of the present invention will be described below through specific examples, and a person skilled in the art may easily understand other advantages and effects of the present invention through the contents disclosed in this specification. The present invention may also be implemented or applied through other different specific implementations, and the details in this specification may be modified or changed without departing from the spirit of the present invention based on different points of view and applications. It should be noted that the embodiments in the present application and the features in the embodiments may be combined with each other under the situation of no conflict.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that, as used in the description herein and throughout the claims that follow, the meaning of "a", "an", and "the" includes plural reference unless the context clearly dictates otherwise. Also, it will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

Figure 4A:
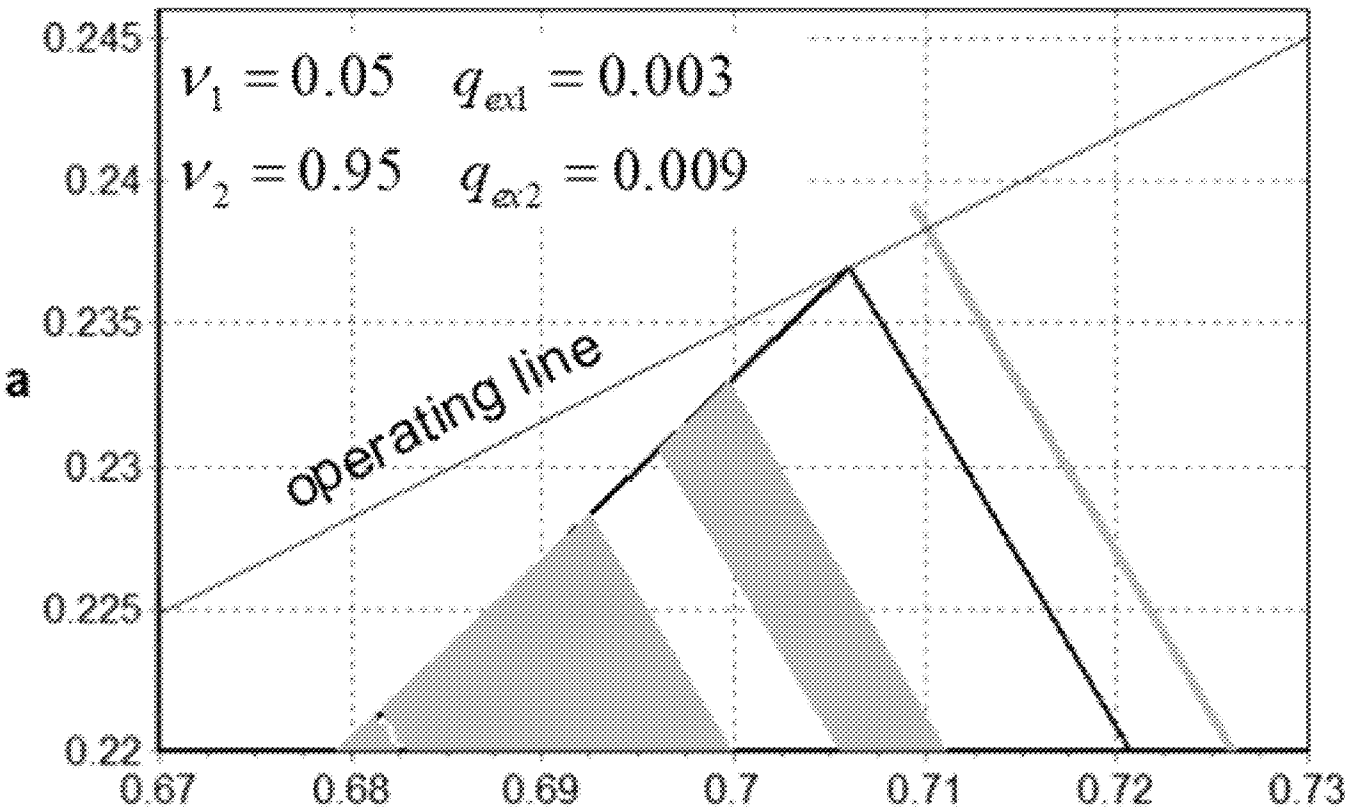
FIG. 4A is a common stability diagram of a mass filter near the tip end of the first stability region in the background under the situation of two quadrupole excitations at the main frequency of 0.05. Excitation intensity is provided in the drawing. Stable motion regions are represented by grey, the boundary of the initial first stability region is represented by a thick black line, and the operating line passes through the end of stability. The excitations are at the same stage. The excitations are opposite.
Figure 4B:
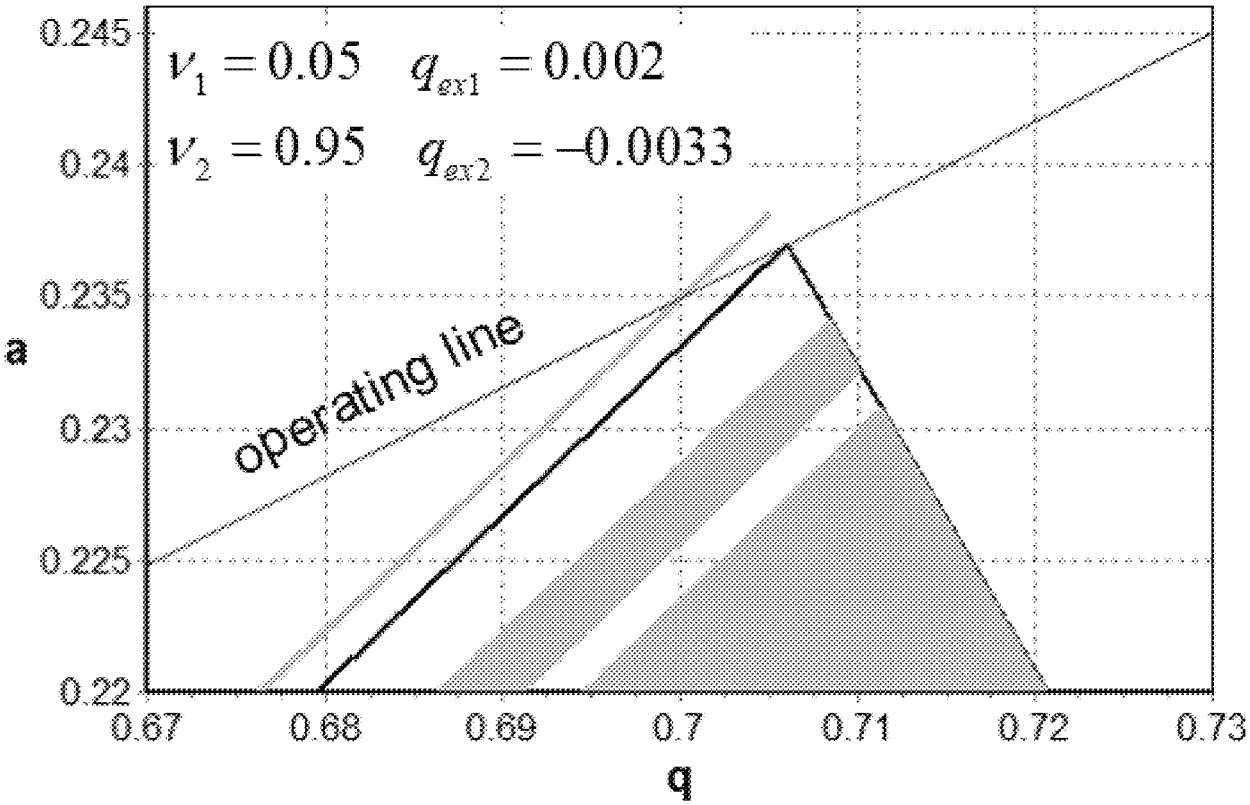
FIG. 4B is a common stability diagram of a mass filter near the tip end of the first stability region in the background under the situation of two quadrupole excitations at the main frequency of 0.05. Excitation intensity is provided in the drawing. Stable motion regions are represented by grey, the boundary of the initial first stability region is represented by a thick black line, and the operating line passes through the end of stability. The excitations are at the same stage. The excitations are opposite.

The existing technical solutions described in the background show that the use of multiple AC excitation voltages will bring about changes in the stability diagram. To facilitate the understanding about the principle of the present invention, a further discussion is described herein. For example, two AC excitation voltages are used in the prior art. As shown in FIG. 4A and FIG. 4B, when the excitation voltages $q_{ex1}$ and $q_{ex1}$ are at a specific frequency ratio, a stability band corresponding to X or Y-direction ion motion is generated outside the initial stability region. In fact, this is because the excitation voltages correspond to the q parameters of the two frequencies, i.e., when the ratio $q_{ex2}/q_{ex1}$ is fixed, the amplitudes generated at these frequencies by the solutions of the extended Mathieu equation of the ion motion in the X or Y direction are just offset, thereby producing an ion stability band similar to an optical diffraction fringe.

It needs to be pointed out that not only can the ion motion terms produced by excitation voltages with two different frequencies be offset, but also when quadrupole excitation is applied in different ways, since different modes of excitation voltage application can produce different vibration frequencies, amplitudes and intensities in the X and Y directions. By using different modes of excitation voltage application and regulating the waveforms, amplitudes and phases of the excitation voltages, it is also possible to obtain a narrow stability band outside the stability region to improve the mass resolution of the quadrupole mass spectrometry.

Without intent to limit the scope of the invention, examples according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Embodiment 1

In the embodiment of studying the influence of the quadrupole excitation signal with an operating frequency of $\omega_{ex}$ on the stability diagram, the quadrupole excitation signal is not superimposed on the RF signal in the form of linear addition, but the quadrupole excitation signal is used as an amplitude modulation signal to modulate an amplitude of the initial RF signal in the form of multiplication operator.

When $\omega_{ex}$ and a frequency $\Omega$ the source RF signal are at a non-integer ratio, for ions with different initial phases introduced into the quadrupole mass analyzer, the phase condition will cause the ion trajectories at the boundary of the stability region to turn back or excite, which usually results in periodic changes in the boundary of the stability diagram depending on the phase of ion implantation, as previously mentioned in the patent of Alan Schoen. The boundary vibration of the stability diagram will cause the stability of ion motion to be sequentially and periodically enhanced and weakened at different q values, resulting in a ringing phenomenon at the boundary of the obtained mass spectrum peaks.

When $\omega_{ex}$ and the frequency $\Omega$ of the source RF signal are at an integer ratio, the situation will be similar to the previously mentioned patent of Kozo Miseki, making the stability diagram of the quadrupole mass analyzer become a series of stability island structures. In the instable mesh band separating the stability islands, the motion frequencies of ions in the X and Y directions are sequentially $\omega_{ex}$, $2\omega_{ex}, \ldots, \Omega/2$. The Mathieu equation of ion motion may be expressed as:

$$\frac{d^2x}{d\xi^2} + [a + 2q\mathrm{Cos}2\xi(1 + 2q_{ex}\mathrm{Cos}(2\nu\xi + \alpha))] \cdot x = 0 \tag{6.a}$$

$$\frac{d^2y}{d\xi^2} - [a + 2q\mathrm{Cos}2\xi(1 + 2q_{ex}\mathrm{Cos}(2\nu\xi + \alpha))] \cdot y = 0 \tag{6.b}$$

where the quadrupole amplitude modulation frequency coefficient is $=\omega_{ex}/\Omega$. When v=0.05, i.e., the frequency of the quadrupole amplitude modulation waveform is 1/20 of a source RF frequency, the two main bands respectively correspond to ion resonance frequencies of 1/20Ω and 19/20Ω. Different from the traditional modulation method of directly linearly superimposing the quadrupole excitation voltage, the main vibration modes of ions in the Y and X directions are just opposite. That is to say, a modulation frequency of 1/20Ω can produce an ion resonance frequency of 1/20Ω in the Y direction. On the other hand, the superimposed quadrupole excitation voltage of 1/20Ω can also produce the ion resonance frequency of 1/20Ω in the Y direction, but the phase is just opposite. Therefore, the above two signals can be superimposed to offset the ion resonance frequency of 1/20Ω in the Y direction and form an instability band.

To analyze the specific structure of the instability band, it is necessary to analyze the solution stability of the case where the RF amplitude modulation signal is applied and the quadrupole excitation voltage is superimposed simultaneously. At this time, the ion motion in the X-Y space satisfies the Mathieu equation as follows:

$$\frac{d^2x}{d\xi^2} + [a + 2q\mathrm{Cos}2\xi(1 + 2q_{ex2}\mathrm{Cos}(2v_2\xi + \alpha_1)) + 2q_{ex1}\mathrm{Cos}(2v_1\xi + \alpha_1)]\cdot x = 0 \tag{7.a}$$

$$\frac{d^2y}{d\xi^2} - [a + 2q\mathrm{Cos}2\xi(1 + 2q_{ex2}\mathrm{Cos}(2v_2\xi + \alpha_1)) + 2q_{ex1}\mathrm{Cos}(2v_1\xi + \alpha_1)]\cdot y = 0 \tag{7.b}$$

where the first AC frequency source is used for driving the first AC excitation voltage between two pairs of rod electrodes in a quadrupole system as shown in FIG. 1, an amplitude of the first AC excitation voltage is smaller than an amplitude V of the RF voltage and is recorded as $V_{ex1}$; the frequency is different and is $\omega_{ex1}$; the superimposed quadrupole excitation frequency coefficient is $v_1=\omega_{ex1}/\Omega$.

In addition, the second AC frequency source is used for modulating the amplitude V of the RF voltage, the modulation frequency is $\omega_{ex2}$, and the modulation frequency coefficient $v_2=\omega_{ex2}/\Omega$.

A simpler method is to make the working frequencies of the two AC frequency sources be equal. At this moment, the frequencies of the excitation voltages of the two AC frequency sources may be expressed as a single frequency, such as v=0.05. Supposing that v=K/P K and P are integers and the common period of the periodic function in equation 7 is πP, equation 7 is transformed to Hill equation (i.e., second-order linear differential equation containing the periodic coefficient). At this moment, a matrix method (such as [Konenkov, N. V.; Sudakov, M. Y.; Douglas, D. J. Matrix Methods for the Calculation of Stability Diagrams in Quadrupole Mass Spectrometry.//J. Am. Soc. Mass Spectrom. 2002, 13, 597-613]) and other mathematical methods may be used to resolve the q parameter distribution with stable trajectories, i.e., stability diagram.

Because the change in the modulation amplitude is usually small and the amplitude of superimposed the quadrupole excitation AC signal is also small, the solution of the above equation can be obtained by adopting a perturbation method with parameters. When the amplitude parameter $q_{ex1}$ is small such as smaller than 0.015, the product factor of the higher-order trigonometric terms of multiplicative modulation and additive modulation may be described by a linear function. At this moment, when the ratio $q_{ex2}/q_{ex1}$ is determined, stable quadrupole excitation offset of $\omega_{ex}$ and Ω/2-$\omega_{ex}$ frequencies can be obtained. When $\omega_{ex}$ in the Y direction is offset, the narrowband stability region of X-direction motion can be obtained, which is referred to as X-band. Contrarily, when $\omega_{ex}$ in the X direction is offset, a narrowband stability region of Y-direction motion can be obtained, which is referred to as Y-band. Usually, $q_{ex2}/q_{ex1}$ needs to be controlled to be approximately 1.5 to deduct the vibration amplitude in the non-interest direction. For larger v values, the non-linear terms of the trigonometric function should be considered. Similar results can be obtained by adopting an approximation method. Another point is that, when the ratio $q_{ex2}/q_{ex1}$ is a smaller fixed value, the ratio $q_{ex2}/q_{ex1}$ produced by the X-band or Y-band is not related to v, which is determined by the characteristic of the expanded Taylor equation of the trigonometric function.

Similarly, we can offset the instable motion in the Y direction by selecting other excitation frequencies to produce an X-band. For example, when $q_{ex2}/q_{ex1}=1.63$, $v_1=v$ and $v_2=1-v$, a narrow stability band result similar to that in FIG. 4A in the prior art can also be obtained. In fact, when the AC amplitude modulation frequency coefficient and the superimposed excitation frequency coefficient are set in the form of A $\omega_{ex}$+BΩ, and when A is a natural number of which the absolute value is smaller than 4, the expanded equation of the ion motion frequency term can be better superimposed to eliminate the directional excitation of ions at the A $\omega_{ex}$ frequency, thus forming a narrow instability band.

When the quadrupole mass analyzer works, the set values of the RF voltage and a quadrupole DC amplitude are the scanning line a=2qλ passing through the vertex of the stability region. In a conventional mode, the mass resolution of the quadrupole is determined by the slope λ=U/V of the scanning line. In the stability band scanning mode, the slope of the scanning line is fixed, and the ions do not have a stable trajectory under the situation of no AC excitation voltage. At this moment, the mass resolution of the quadrupole is determined by the width of the stability band, and the width of the stability band is determined by the ratio $q_{ex2}/q_{ex1}$ of an AC amplitude modulation depth to the superimposed excitation voltage amplitude, or is recorded as the parameter AM2ratio (Amplitude-Modulation 2 parameter ratio). The theoretical mass resolution is $R=q_{centre}/\Delta q$, where $\Delta q=q_1-q_2$, which represents the distance between the two intersections of the scanning line and the stability region, where $q_{centre}$ is a median.

As shown in Table 1, a relationship between theoretical mass resolution and AM2ratio parameter is shown. This method is used for producing the mass resolution of the X-band, where the nondimensionalized frequency, i.e., the frequency ratio of the AC excitation voltage to the main RF voltage v=0.05. In the table, Q1 and Q2 are respectively the q values of the two edges forming the stability band, DeltaQ shows the width of the mass stability band. aA and qA are the coordinates of the top vertex of the stability band, the ratio determines the maximum kMax of the slope of the scanning line of the quadrupole, aB and qB are vertex coordinates of the stability island below, the ratio determines the minimum kMin of the slope of the scanning line of the quadrupole, and when it is below this value, the scanning line cuts off the stability island below to produce ghost peaks. According to the q difference width of the band, the limit mass spectrum resolution Theo. Res value under the corresponding conditions can be obtained.

TABLE 1

Relationship between theoretical mass resolutions and AM2ratio parameters

| AC1/RF | AM 2ratio | Q 1 | Q 2 | DeltaQ | aA | qA | kM ax |
|---|---|---|---|---|---|---|---|
| 0 | 1.5646 | | | | 0.236995 | 0.70598 | 0.167848 |
| 0.001 | 1.5617 | 0.70719 | 0.70502 | 0.00217 | 0.2369 | 0.70576 | 0.16782 |
| 0.002 | 1.5588 | 0.70783 | 0.70647 | 0.00136 | 0.23747 | 0.70682 | 0.167985 |
| 0.003 | 1.5559 | 0.70917 | 0.70835 | 0.00082 | 0.23807 | 0.70766 | 0.16821 |
| 0.004 | 1.553 | 0.70991 | 0.70937 | 0.00054 | 0.23865 | 0.70871 | 0.16838 |
| 0.005 | 1.5501 | 0.71123 | 0.71084 | 0.00039 | 0.23944 | 0.71038 | 0.16853 |
| 0.006 | 1.5472 | 0.71418 | 0.71394 | 0.00024 | 0.24065 | 0.71164 | 0.16908 |
| 0.007 | 1.5443 | 0.716045 | 0.715859 | 0.000186 | 0.241602 | 0.713142 | 0.169392 |
| 0.008 | 1.5414 | 0.717886 | 0.717761 | 0.000125 | 0.242599 | 0.714656 | 0.169731 |
| 0.009 | 1.5385 | 0.719889 | 0.719813 | 0.000076 | 0.2437 | 0.716502 | 0.170146 |
| 0.01 | 1.5356 | 0.72179 | 0.721738 | 0.000052 | 0.244596 | 0.718055 | 0.170319 |
| 0.011 | 1.5327 | 0.72384 | 0.723806 | 0.000034 | 0.245762 | 0.719695 | 0.170741 |
| 0.012 | 1.5298 | 0.725753 | 0.725726 | 0.000027 | 0.246251 | 0.722018 | 0.170529 |
| 0.013 | 1.5269 | 0.727757 | 0.727737 | 0.00002 | 0.247919 | 0.723339 | 0.171371 |
| 0.014 | 1.524 | 0.729761 | 0.729746 | 0.000015 | 0.249182 | 0.724978 | 0.171855 |
| 0.015 | 1.5211 | 0.731765 | 0.731754 | 0.000011 | 0.249934 | 0.727119 | 0.171866 |

| AC1/RF | aB | qB | Km in | Theo.RES |
|---|---|---|---|---|
| 0 | | | | |
| 0.001 | 0.23595 | 0.70704 | 0.16686 | 325.394 |
| 0.002 | 0.23589 | 0.70783 | 0.16698 | 519.9632 |
| 0.003 | 0.23646 | 0.70917 | 0.16671 | 864.3415 |
| 0.004 | 0.23679 | 0.71046 | 0.16665 | 1314.148 |
| 0.005 | 0.23727 | 0.712139 | 0.16659 | 1823.167 |
| 0.006 | 0.23778 | 0.71419 | 0.16647 | 2975.25 |
| 0.007 | 0.23828 | 0.716045 | 0.166387 | 3857.498 |
| 0.008 | 0.239102 | 0.717886 | 0.166533 | 5742.588 |
| 0.009 | 0.239672 | 0.719889 | 0.166464 | 9471.728 |
| 0.01 | 0.240515 | 0.72179 | 0.16661 | 13880.07 |
| 0.011 | 0.24132 | 0.72384 | 0.166694 | 21288.9 |
| 0.012 | 0.242204 | 0.725753 | 0.166864 | 26879.23 |
| 0.013 | 0.243161 | 0.727757 | 0.167072 | 36387.35 |
| 0.014 | 0.243992 | 0.729761 | 0.167173 | 48650.24 |
| 0.015 | 0.245017 | 0.731765 | 0.167415 | 66523.62 |

From the table, it can be learned that, when AM2ratio is set to a corresponding proper value, the higher the combination of excitation voltage and the modulation amplitude, the higher the resolution can be obtained. It needs to be noted that, when the slope $\lambda=U/V$ of the scanning line is too small, the scanning line will pass through the stability region to produce ghost peaks. By setting the working conditions of the quadrupole mass analyzer according to the above parameters in the table, the maximum mass resolution up to approximately 66,000 can be obtained. Herein, the frequency ratio $\Omega/\omega_{ex1}$ of the RF power supply to the first AC frequency source is an integer greater than or equal to 5. Because cheap available solutions can be easily found for the divide-by-2, divide-by-5 and divide-by-10 frequency dividers, the condition of divide-by-20 frequency division, i.e., v=0.05, is usually adopted. A modulation depth of the second AC frequency source for forming the RF amplitude modulation to the output voltage of the RF power supply is in a range of 90% to 110%. Usually, the modulation depth of the second AC frequency source to the output voltage of the RF power supply and the amplitude $V_{ex1}$ of the excitation voltage generated by the first AC frequency source maintain a linear relationship.

Embodiment 2

Table 2 shows combinations of AC amplitude modulation frequency coefficients $v_2$ causing the production of the X-band and superimposed excitation frequency coefficients $v_1$ and frequency ratios thereof, which are arranged according to frequency from low to high. Table 3 shows simulation of the quadrupole in a traditional mode under the situation of an X-band. All amplitudes are zero peaks.

TABLE 2

Combinations of AC amplitude modulation frequency coefficients

| | O | I | II | III | IV | V | VI |
|---|---|---|---|---|---|---|---|
| $v_1$= | v | v | v | 1 − v | 1 − v | 1 + v | 1 + v |
| $v_2$= | v | 1 − v | 1 + v | 2 − v | 2 + v | 2 − v | 2 + v |
| $q_{ex2}/q_{ex1}$= | 1.54 | 1.63 | 1.72 | 3.31 | 3.45 | 4.55 | 3.38 |

TABLE 3

Simulation of the quadrupole in a traditional mode under the situation of an X-band.

| | DC | RF | AC-1 | AC-2 | AMRF % |
|---|---|---|---|---|---|
| Frequency, KHz | 0 | 1200 | 60 | 1130 | 60 |
| Conventional | 141.69 V | 844.33 V | 0 | 0 | |
| Xband-Prior Art | 144.33 V | 857.25 V | 6.85 V | 20.16 V | |
| Xband-AMRF | 144.19 V | 856.47 V | 6.85 V | 0 | +/−2.48% |

According to Table 1 above, by using amplitude modulation RF in combination with the quadrupole excitation voltage to form an X-band to perform quadrupole mass analysis scanning, a very high mass resolution can be obtained. However, it needs to be noted that this is only a theoretical numerical simulation situation in an infinite long quadrupole. In actual application, as mentioned above, the mass resolution is first restricted by the residence time of ions in the quadrupole, which will correspondingly become poor in a finite long rod. For example, we use a quadrupole with an electric field radius of $r_0$=4 mm and length of 200 mm for simulation. First the influence of the field distortion at both ends of the rod system is not considered, and the electric field along the quadrupole is set as a pure quadrupole field (hyperboloidal electrode) to ignore the high-order field effect at both ends. When the quadrupole works under the condition of an RF frequency of 1.2 MHz, ions of 609 Da can obtain a mass resolution of 10,000 in the traditional mode. The corresponding power supply is set according to the condition in "Conventional" in Table 3. In a new operating mode, we select another condition in Table 2, and an amplitude of the corresponding AC excitation voltage is expressed by "Xband-AMRF" in Table 3. Under this condition, the ion mass resolution of reserpine with a mass of 609 is also approximately 10,000. To analogize the prior art of Sudakov et al., their conditions are transcribed in "Xband-Prior Art".

From the above table, it can be learned that, when an amplitude modulation mode is used, the second excitation voltage of 1.14 MHz in the prior art can be avoided, which is very helpful for the design of the drive power supply of the high-resolution quadrupole mass analyzer, because in this case, if the second excitation voltage of 1.14 MHz is used, its amplitude will also be acquired by the control circuit through sampling feedback because its frequency is very close to the main RF frequency. Since a rectifying circuit is usually used in sampling feedback, its feedback depth is usually reflected as the absolute value of instantaneous high frequency RF signal. However, an amplitude of the second excitation voltage of 1.14 MHz is higher and will form a beat frequency pattern with the rectification value of the initial RF signal, which makes the feedback value of the feedback circuit fluctuate at phases of different RF and AC, and is very disadvantageous to form a stable RF signal.

However, when we use the modulation solution provided by the present invention, since the AC voltage of 1.14 MHz is avoided, only 60 KHz modulated and superimposed AC waveform signals appear in the whole system. At this moment, because 60 KHz is far from the frequency band 1.2 MHz, very simple high-pass and low-pass filters can perfectly realize the superimposition of mixing signals on the quadrupole. At the same time, it is easy to remove the influence of the excitation signal. Furthermore, we can even offset the influence of spurious noise in the circuit by actively generating reverse 60 KHz signals.

Figure 5:
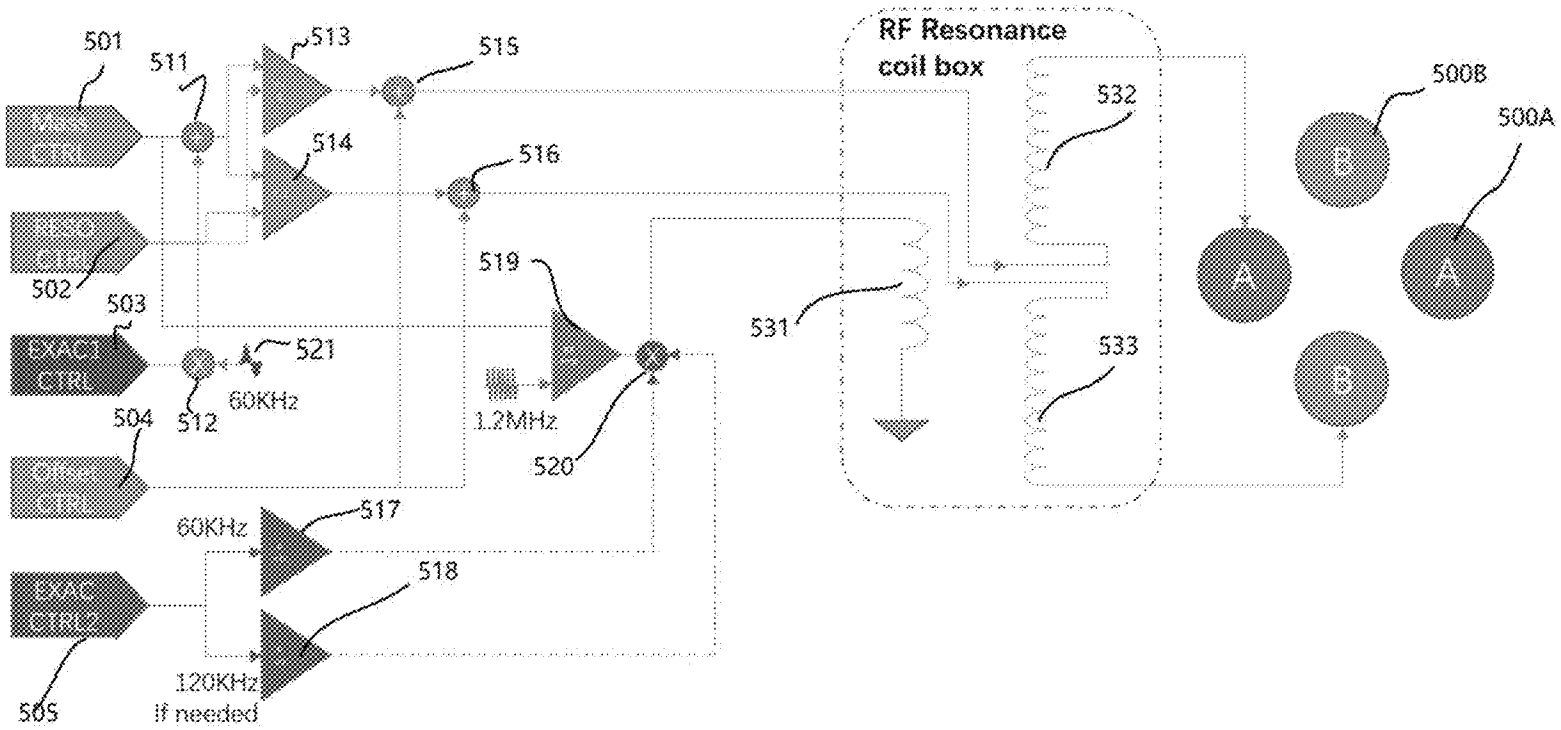
FIG. 5 is a circuit schematic block diagram for forming an X-band stable mass filter band through RF amplitude modulation according to one embodiment of the present invention.

As shown in FIG. 5, a circuit schematic block diagram capable of effectively forming an X-band stable mass filter band through RF amplitude modulation, where a mass control signal 501 is mixed with a signal from a first AC source 521 through an adder 511, the intensity of the superimposed AC signal source is modulated by a first excitation voltage signal source 503 through a multiplier 512, the formed mixed control signal is superimposed with the signal of a resolution control DC voltage source 502 for controlling quadrupole DC intensity respectively through a forward superimposer 513 and a reverse superimposer 514, and the signals are respectively applied to a quadrupole electrode pair 500A and a quadrupole electrode pair 500B through an additive amplifying circuit. When the bias voltage of the quadrupole pair needs to be corrected, the above output DC voltage may be biased by a biasing DC voltage source 504 through an additive amplifying circuit 515 and an additive amplifying circuit 516.

At the same time, to effectively control the modulation amplitude of the quadrupole RF signal, the second AC source 505 forms an amplitude modulation signal, a excitation voltage may be amplified through a frequency selective amplifier 517, such as 60 KHz in the drawing. This waveform forms a modulated amplitude signal on a multiplier circuit 520 with the output of the above mass control signal at the frequency selective amplifier 519 of 1.2 MHz, so that the signal can transfer RF energy to a secondary amplifying coil 532 and a secondary amplifying coil 533 through a primary coil 531 of a resonant transformer, thus generating a combination of AC and RF signals for constraining ions.

It needs be further pointed out that, in the synthesis of RF amplitude modulation signal and superimposed quadrupole excitation voltage signal, the pass bandwidth of various multipliers is limited. Some solutions may be adopted to overcome these problems, such as by introducing a second frequency selective amplifier 518 to introduce other signal frequencies. The combination of 505, 517 and 518 may also be implemented by other means in some cases, such as multiple mixer networks or chips, or direct waveform synthesis of the above frequency combination.

When an ion beam composed of ions with similar mass number moves in a quadrupole, it will have a random distribution of approximately 0.1 mm in transverse motion. Because all ions fly in the direction of the quadrupole with the same energy, they also fly for the same time. The time that ions enter the quadrupole is from 0 μs to 20 μs for uniform distribution, so the ions entering the quadrupole are not only in all possible RF phases, but also in all phases of the AC excitation voltage. Finally, the ions will reach a normal distribution, where the transverse energy standard deviation is 0.025 eV, which is equivalent to the thermal motion energy of ions at 320 K. At each time of simulation, we set 10,000 ions with the same mass and energy. For other conditions, we randomly distribute them. When they hit the quadrupole or disappear or are transmitted to the other end of the quadrupole, the simulation stops. Then we record the number of ions transmitted, and then set ions with another mass number to simulate till different peak shapes are formed as shown in the drawing. In practice, the quadrupole works in another way, i.e., scanning RF and DC voltages, and the nominal mass of ions can be obtained from the RF voltage. Therefore, compared with the real experiment, in the simulation herein, the peaks of both low mass number and high mass number will appear.

Figure 6:
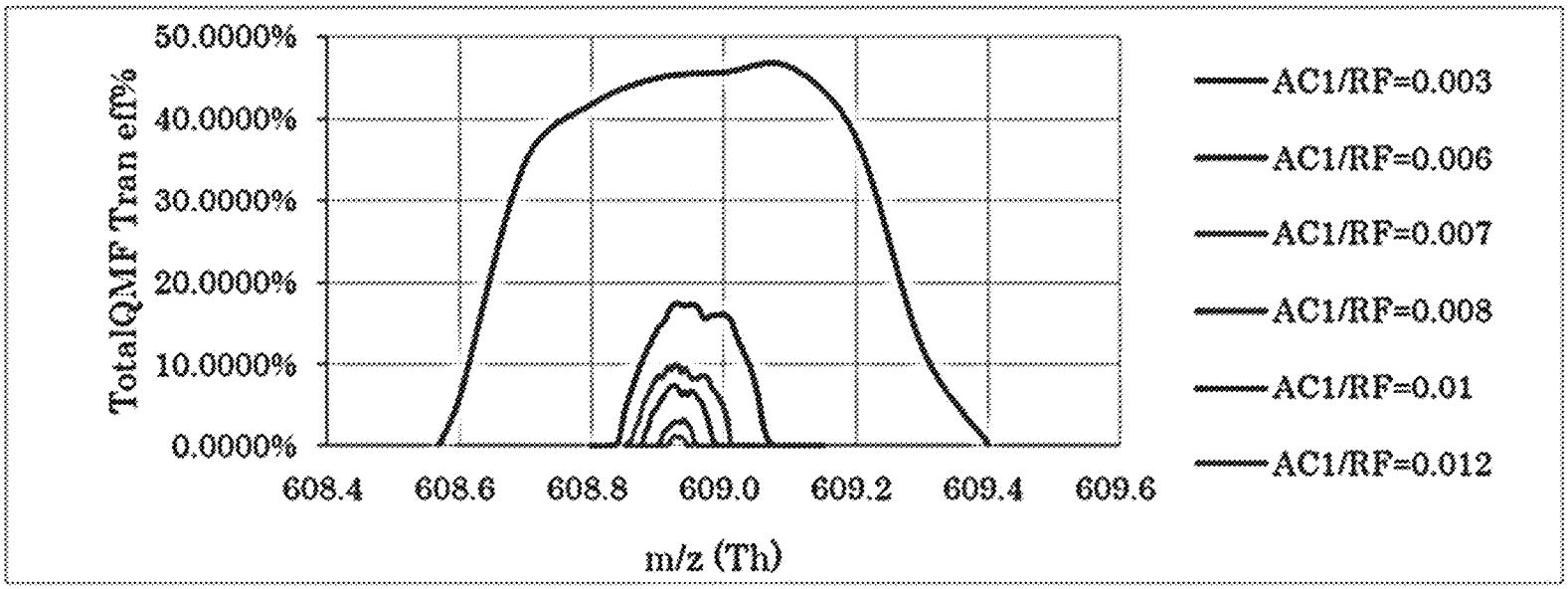
FIG. 6 is a mass spectrogram formed by increasing a quadrupole excitation voltage to improve quadrupole resolution in an RF amplitude modulation-assisted quadrupole excitation method according to one embodiment of the present invention.

It can be learned that, even under the situation of the lowest mass resolution, a lot of ions (approximately half) are lost. This is caused by the initial distribution of ion velocity and position. Adjusting to increase the ratio of the quadrupole excitation voltage to the main RF intensity can make the resolution of the mass analyzer increase rapidly. As shown in FIG. 6, a mass spectrogram formed by increasing a quadrupole excitation voltage to improve quadrupole resolution in an RF amplitude modulation-assisted quadrupole excitation method is illustrated, and the resolution is gradually improved.

When simulation is performed in a traditional mode (i.e., without AC excitation voltage), the theoretical mass resolution is also 10,000 at the maximum ion passing efficiency, but the mass resolution is more and more affected by the ion flying time. Since the peak shape in this mode is well known, there is a very serious tailing on the side of the high mass number. The maximum mass resolution can be obtained from equation (5).

Figure 7:
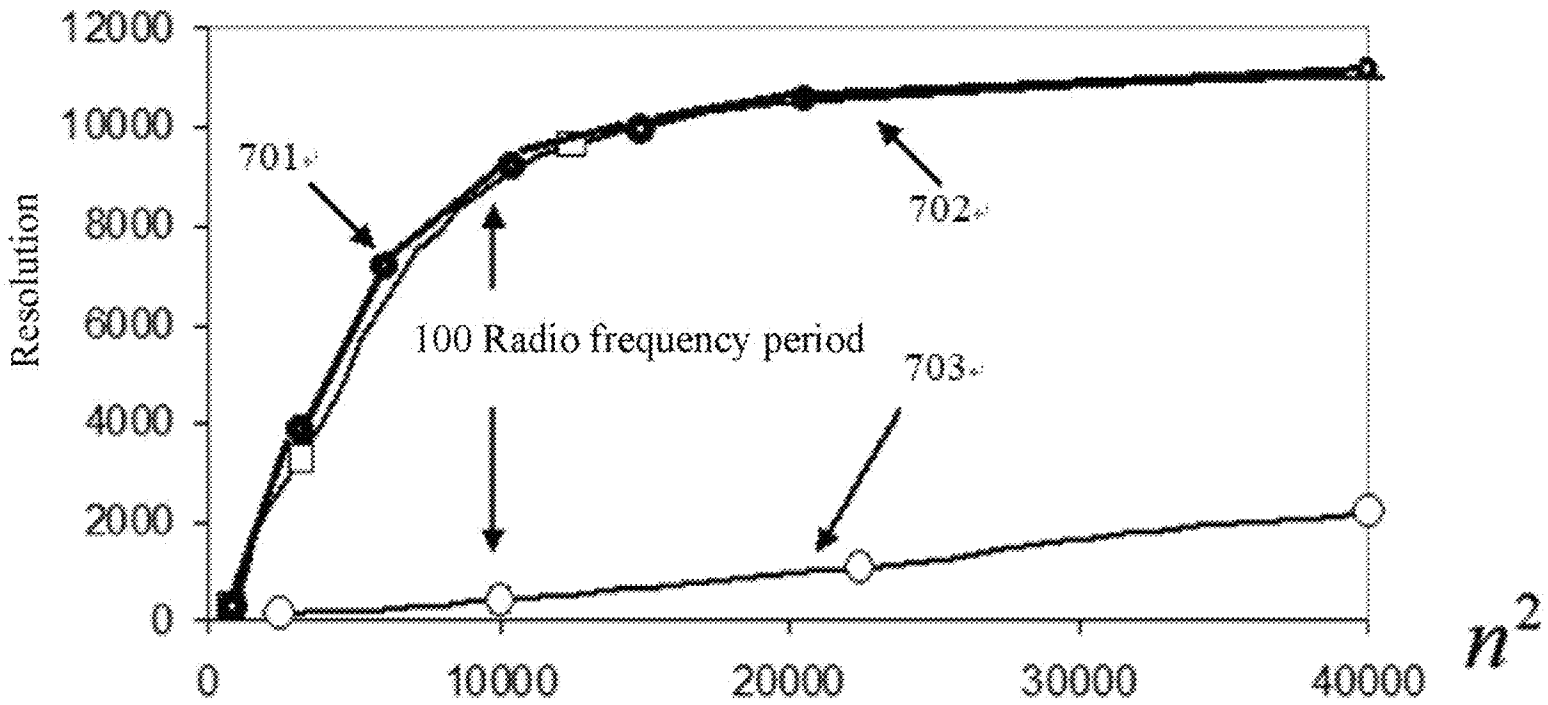
FIG. 7 is a schematic diagram of a dependence relationship between the most possible resolution and the square of residence time in the traditional technical solution and the improved technical solution of the present invention.

As shown in FIG. 7, a relationship between mass resolution and periodic motion period number n2 in two modes of quadrupole excitation for forming an X-band (701, the RF amplitude modulation-assisted quadrupole excitation method of the present invention, and 702, forming an X-band through two additional assisted quadrupole excitation voltages in the prior invention) is illustrated. To compare the improvement of the method, a curve 703 indicates a mass resolution relationship of the quadrupole without any quadrupole excitation in the traditional method.

The simulation results are shown in FIG. 7, where the mass resolution is in proportion to the square of the periodic motion period number. In the traditional mode, the mass resolution is only 500 at 100 RF periods. Contrarily, the mass resolution of 9,000 can be obtained by scanning with the X-band.

Here's an explanation. Obviously, compared with the traditional mode, the instable motion speed of instable motion ions near the X-band of the boundary of the stability region is higher, and they disappear faster when they hit the quadrupole. When the frequency v is low, the two AC excitation voltages with frequencies $v_1=v$ and $v_2=1-v$ modulate the ion trajectories, which leads to the instability of motion in the X-direction outside the X-band. The RF frequency Ω and parameters $q_{ex1}$ and q are also used in equation (7) for comparison. If a smaller frequency v is used for replacing Ω, $q_{ex1}$ will become very large, which will make it difficult to realize the actual voltage. In the above simulation, v=0.05. However, because the effective value of $q_{ex1}$ will resonate with the modulation envelope of RF, it can be enlarged by 400 times after 20 periods in fact. That is to say, when $q_{ex1}=0.0068$, the effective value of actual q is 2.72, which also corresponds to the region with high q value in Mathieu equation. Therefore, the instable motion of ions is more intense. The ions can be separated after only a few of RF periods. For higher separation period numbers, the effective q value for ion separation will further increase. At this moment, the actual ion separation effect is similar to the situation of the fourth stability region using q=27.2 in [Wei Chen, B. A. Collings, and D. J. Douglas, High-Resolution Mass Spectrometry with a Quadrupole Operated in the Fourth Stability Region,//Anal. Chem. 2000, 72, 540-545]. In our simulation, the instable ions with a mass difference of 0.08 can be enabled to hit the quadrupole and disappear within only 100 RF periods, so as to obtain higher resolution.

Therefore, the X-band is similar to a region with a high q value when the frequency v is low. The influence of this method on the resolution of ions with a mass of 609 under different resolution widths is shown in FIG. 8.

Figure 8:
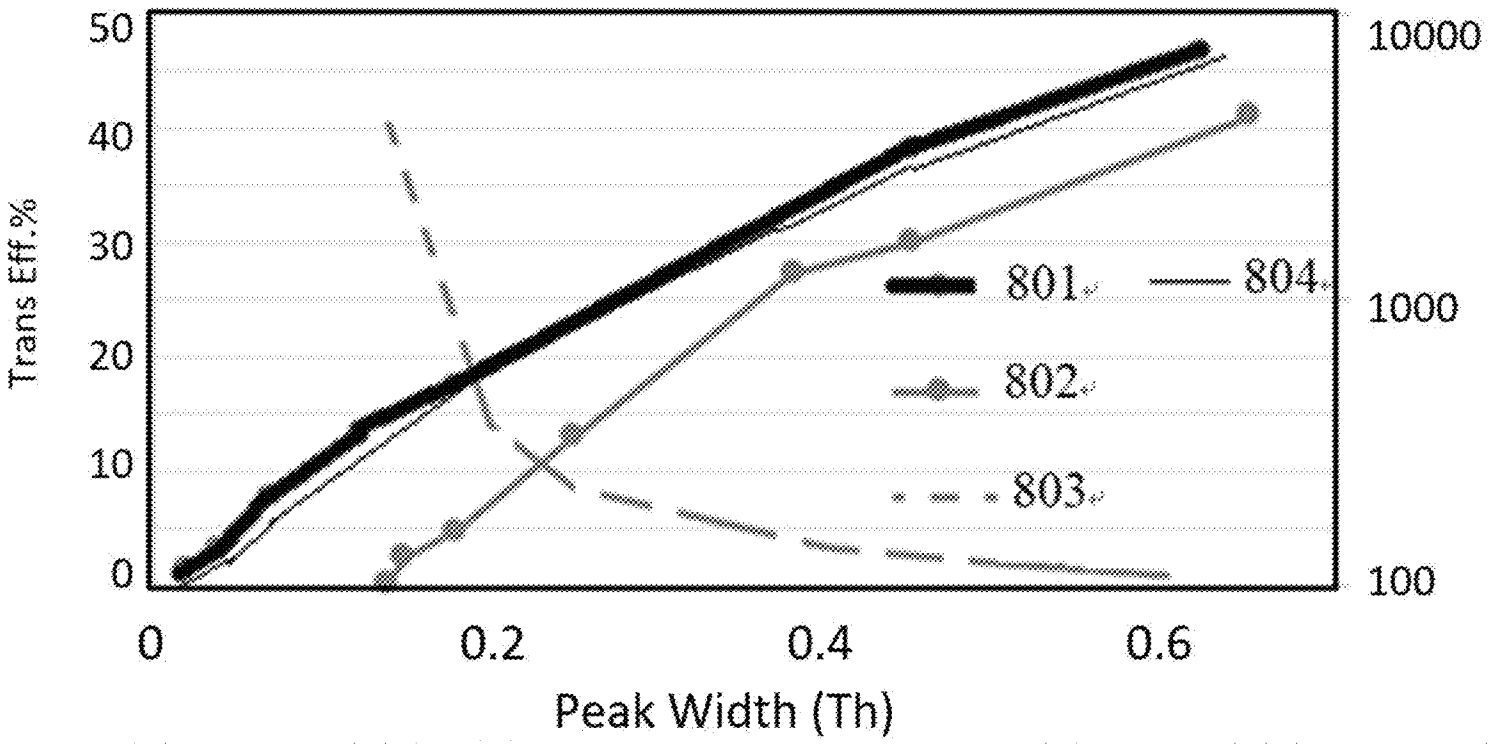
FIG. 8 shows influences of ion signal intensity under different mass spectrum resolution widths according to one embodiment of the present invention.

In FIG. 8, the method of using RF amplitude modulation to superimpose the quadrupole excitation voltage shown by 801, compared with the method of the traditional quadrupole mass analyzer shown by 802 and the result of the double quadrupole excitation superposition method of Saudakov shown by curve 804, can achieve the enhancement of signals under each resolution situation. Especially as shown by the improved rate curve of the new method shown by 803 compared with the traditional method, by adopting this method, the resolution efficiency of the quadrupole mass analyzer to the ions can be significantly improved indeed and higher ion transport efficiency can be obtained, especially under the situation of high resolution.

When the quadrupole is applied with the AC excitation voltage, the produced field distortion is much smaller. A pure quadrupole electric field is formed by an ideally symmetric and parallel hyperboloidal rod on an infinite length. However, in practice, this is impossible, and the quadrupole is often processed into a cylindrical rod. In the traditional mode, the ratio of the radius R of the rod to the radius $r_0$ of the electric field is generally 1.12 to 1.13, so as to offset the influence of field distortion and achieve better performance at the same time. Although the influence of non-linear field distortion is very small, it will seriously influence the performance of the quadrupole, resulting in peak distortion, tailing and loss of ion transmission. When the quadrupole works at a high resolution, these problems become more serious. Other distortions such as rod dislocation, rod bending, rod shape distortion, surface irregularity or surface contamination will bring more unpredictable influences. When an additional AC excitation voltage is applied, many of these influences are weakened or even disappear. Experiments [X. Zhao, Z. Xiao and D. J. Douglas, "Overcoming field imperfections of quadrupole mass filters with mass analysis in islands of stability", Anal. Chem. 81, 5806, (2009)] confirm this. Because the quadrupole mass analyzer solution in this method is also based on quadrupole AC excitation, this method can also have the small mechanical structure and size of analyzer devices, and resist dirt.

Embodiment 3

In this embodiment, a commercial quadrupole mass spectrometry instrument (Shimadzu Corporation, LCMS2020) is modified. The length of the main rod of the quadrupole in the instrument is 200 mm, and the incircle radius is 4 mm. By adopting several different voltage settings, stability diagrams of transmission regions of ions under an X-band can be drawn, as shown in FIGS. 9A-9C.

Figure 9A:
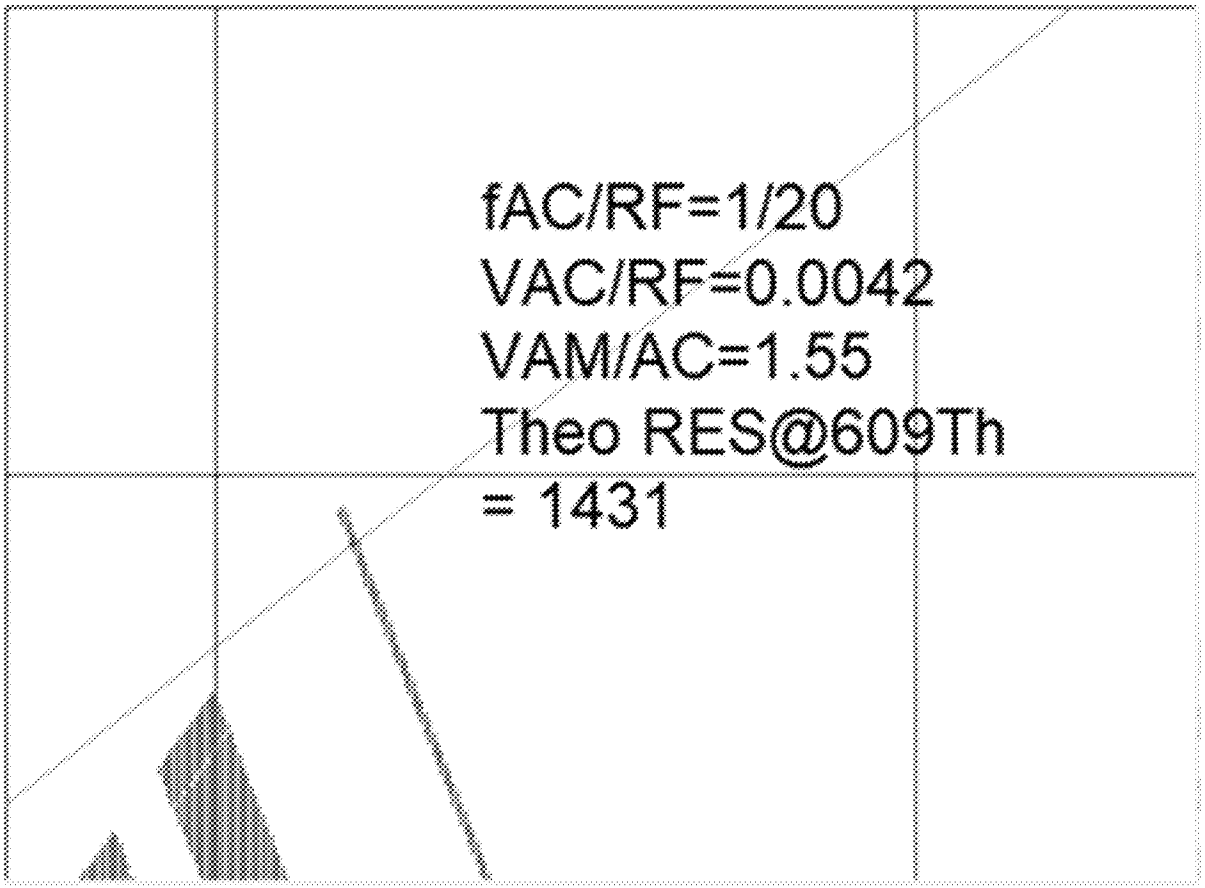
FIG. 9A shows a stability diagram structure of an X-band under a unit resolution condition formed by simulating an RF amplitude-assisted quadrupole excitation method according to one embodiment of the present invention.
Figure 9B:
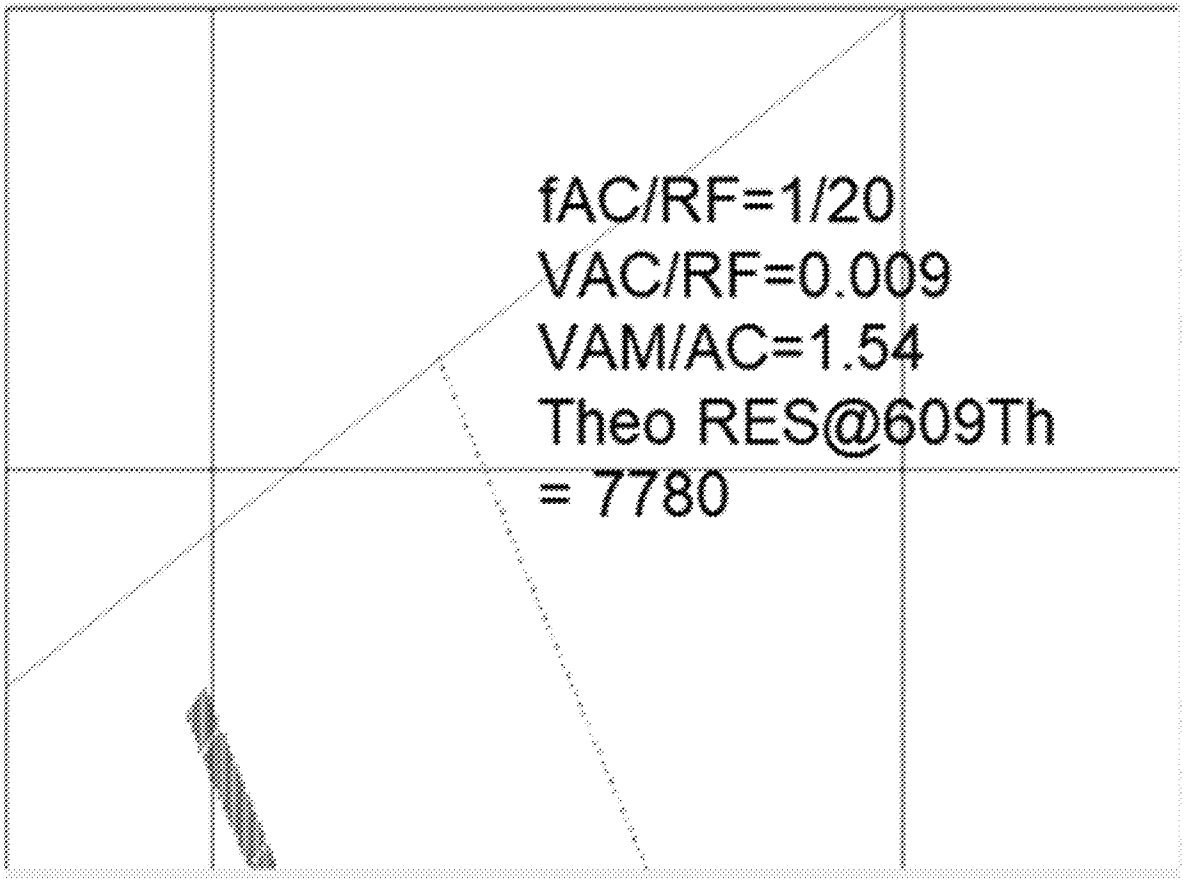
FIG. 9B shows a stability diagram structure of an X-band under a high resolution condition formed by simulating an RF amplitude-assisted quadrupole excitation method according to one embodiment of the present invention.
Figure 9C:
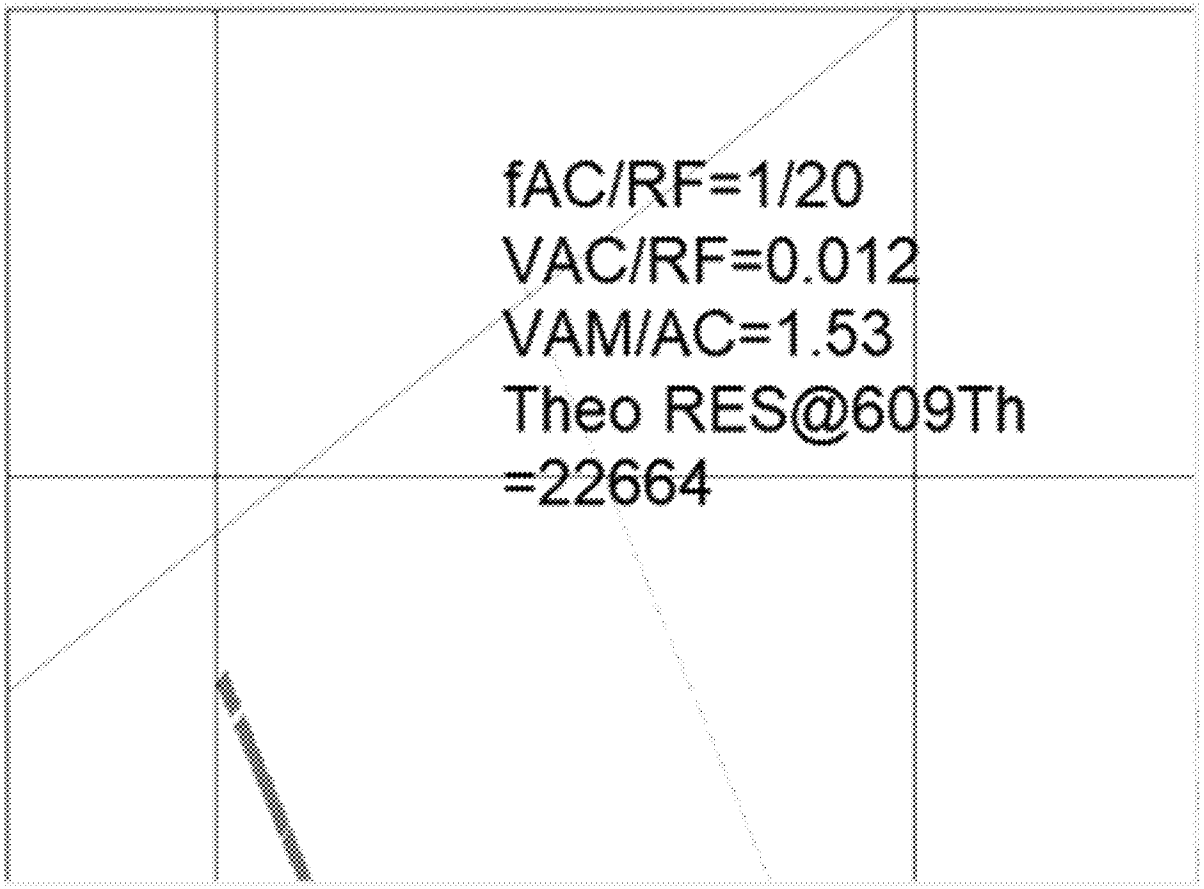
FIG. 9C shows a stability diagram structure of an X-band under an ultrahigh resolution condition formed by simulating an RF amplitude-assisted quadrupole excitation method according to one embodiment of the present invention.

FIGS. 9A-9C respectively show stability diagram structures of an X-band formed under a unit resolution, a high resolution and an ultra-high resolution by simulating an RF amplitude-assisted quadrupole excitation method.

From FIGS. 9A-9C, it can be learned that, in FIG. 9A, when VAC/VRF=0.0042, for reserpine ions with a mass number of 609, the resolution can reach 1431, and at the time, the transmission efficiency of the quadrupole mass analyzer is 33%; as shown in FIG. 9B, if this value is increased to approximately 2 times, the resolution of these ions can reach 7780 and is approximately increased by 5.5 times, while the transmission efficiency can reach 15% and is decreased by only half; and as shown in FIG. 9C, when VAC/VRF reaches 0.012, a very good resolution result can be obtained, and in the simulation results, a resolution of 22,000 or more can be obtained at passing efficiency of 2.8%.

In the experiment, by simultaneously modulating the RF voltage of the modified quadrupole mass analyzer system according to the above parameters and compensating the applied excitation voltage, the preliminary results prove the superiority of the method of forming an X-band through an RF amplitude modulation-assisted quadrupole excitation method.

Table 4 below gives results of comparison between the conventional U-V scanning method and the RF amplitude modulation-assisted quadrupole excitation method. Specifically, results of comparison between conventional QMS resolution and AMX band signals with similar or better FHWM resolution are shown.

TABLE 4

Results of comparison between the conventional U-V scanning method and the RF amplitude modulation-assisted quadrupole excitation method

| Prior art | | | Present invention | | |
|---|---|---|---|---|---|
| Existing test condition | FHWM | Sensitivity (signal Intensity) | FHWM | Sensitivity (signal Intensity) | Test conditions of the present invention |
| U-V scanning mode under condition of 1.2 MHz RF voltage | 0.65 | 0.91 | 0.648 | 0.934 | Based on of the existing test condition, additionally applying a 60 KHz, 72 mV modulation signal to the mass control input voltage terminal of the quadrupole, and additionally applying a 2.8 V 60 KHz quadrupole excitation signal between the two pairs of quadrupoles at the same time |
| | 0.53 | 0.792 | 0.501 | 0.833 | Based on of the existing test condition, additionally applying a 60 KHz, 86 mV modulation signal to the mass control input voltage terminal of the quadrupole, and additionally applying a 3.2 V 60 KHz quadrupole excitation signal between the two pairs of quadrupoles at the same time |
| | 0.44 | 0.318 | 0.397 | 0.549 | Based on of the existing test condition, additionally applying a 60 KHz, 99 mV modulation signal to the mass control input voltage terminal of the quadrupole, and additionally applying a 3.7 V 60 KHz quadrupole excitation signal between the two pairs of quadrupoles at the same time |
| | 0.34 | 0.176 | 0.343 | 0.441 | Based on of the existing test condition, additionally applying a 60 KHz, 132 mV modulation signal to the mass control input voltage terminal of the quadrupole, and additionally applying a 4.6 V 60 KHz quadrupole excitation signal between the two pairs of quadrupoles at the same time |
| | 0.319 | 0.085 | 0.306 | 0.279 | Based on of the existing test condition, additionally applying a 60 KHz, 142 mV modulation signal to the mass control input voltage terminal of the quadrupole, and additionally applying a 5.0 V 60 KHz quadrupole excitation signal between the two pairs of quadrupoles at the same time |
| | 0.235 | 0.038 | 0.231 | 0.098 | Based on of the existing test condition, additionally applying a 60 KHz, 152 mV modulation signal to the mass control input voltage terminal of the quadrupole, and additionally applying a 5.5 V 60 KHz quadrupole excitation signal between the two pairs of quadrupoles at the same time |
| | 0.152 | 0.0098 | 0.152 | 0.0172 | Based on of the existing test condition, additionally applying a 60 KHz, 188 mV modulation signal to the mass control input voltage terminal of the quadrupole, and additionally applying a 6.2 V 60 KHz quadrupole excitation signal between the two pairs of quadrupoles at the same time |

From the table, it can be learned that, basically, under the condition that the resolution is 0.1 to 0.4 unit mass, approximately 2 to 3 times of signal enhancement brought by the RF amplitude modulation-assisted quadrupole excitation method are observed. For example, when the unmodified quadrupole analyzer scans the peak shape of reserpine, if a unit mass resolution is obtained, under the condition of RF of 1.2 MHz, the relative signal intensity that can be obtained by the instrument is 0.91. However, if the resolution is expected to be improved to 0.3 FHWM, the signal intensity of the ions will drop to approximately 0.085, which will cause the overall signal sensitivity of the instrument to be reduced by one order of magnitude. When a cascade mass spectrometer with two quadrupoles is used, the signal sensitivity of the instrument will be reduced by two orders of magnitude. However, if a 60 KHz, 142 mV modulation signal is additionally applied to the mass control input voltage terminal of the quadruple based on of the original equipment, and a 5.0 V 60 KHz quadrupole excitation signal is additionally applied between two pairs of quadrupoles at the same time, the signal intensity similar to FHWM can reach 0.279. The pass rate is reduced only by half order of magnitude relative to the original condition. If this method is used, when a 60 KHz, 152 mV modulation signal is additionally applied to the mass control input voltage terminal of the quadrupole based on of the original equipment, and a 5.5 V 60 KHz quadrupole excitation signal is additionally applied between two pairs of quadrupoles at the same time, the signal intensity of 0.098 can be obtained. Relative to the signal intensity of 0.085 in the high-resolution mode of the original unmodified instrument, the signal intensity is improved by 15%, but the mass resolution width of ions can be improved by approximately 0.23 unit mass.

Figure 10A:
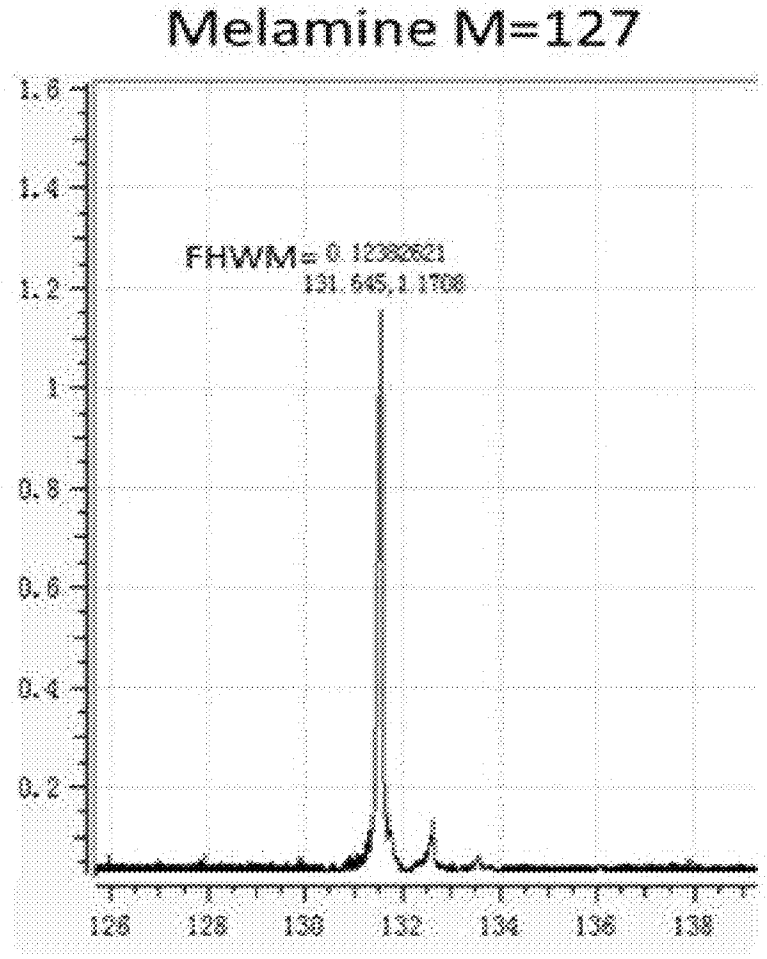
FIG. 10A is a high-resolution spectrogram formed by using melamine as an analyte through RF modulation and quadrupole excitation waveforms formed by adopting a self-compensation method according to one embodiment of the present invention.
Figure 10B:
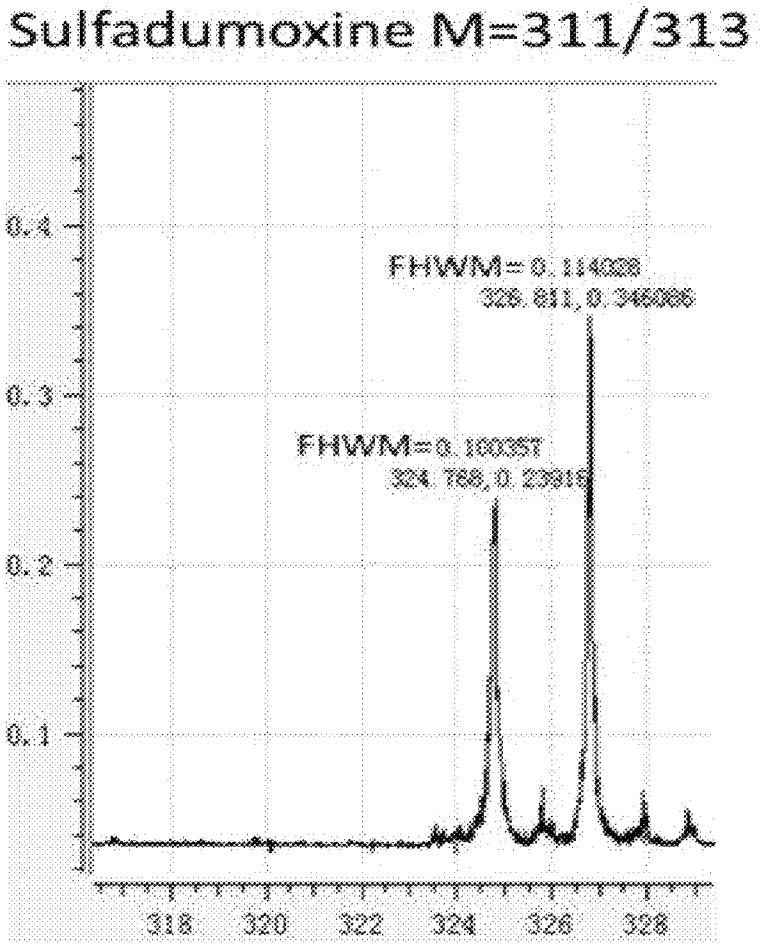
FIG. 10B is a high-resolution spectrogram formed by using sulfadoxine as an analyte through RF modulation and quadrupole excitation waveforms formed by adopting a self-compensation method according to one embodiment of the present invention.
Figure 10C:
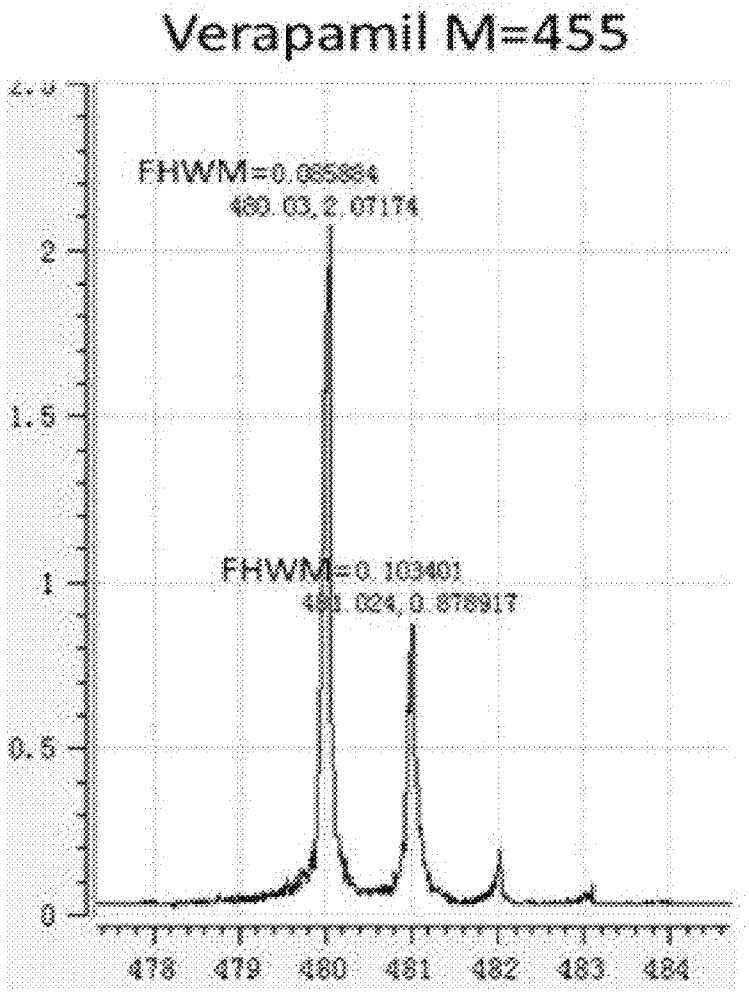
FIG. 10C is a high-resolution spectrogram formed by using verapamil as an analyte through RF modulation and quadrupole excitation waveforms formed by adopting a self-compensation method according to one embodiment of the present invention.
Figure 10D:
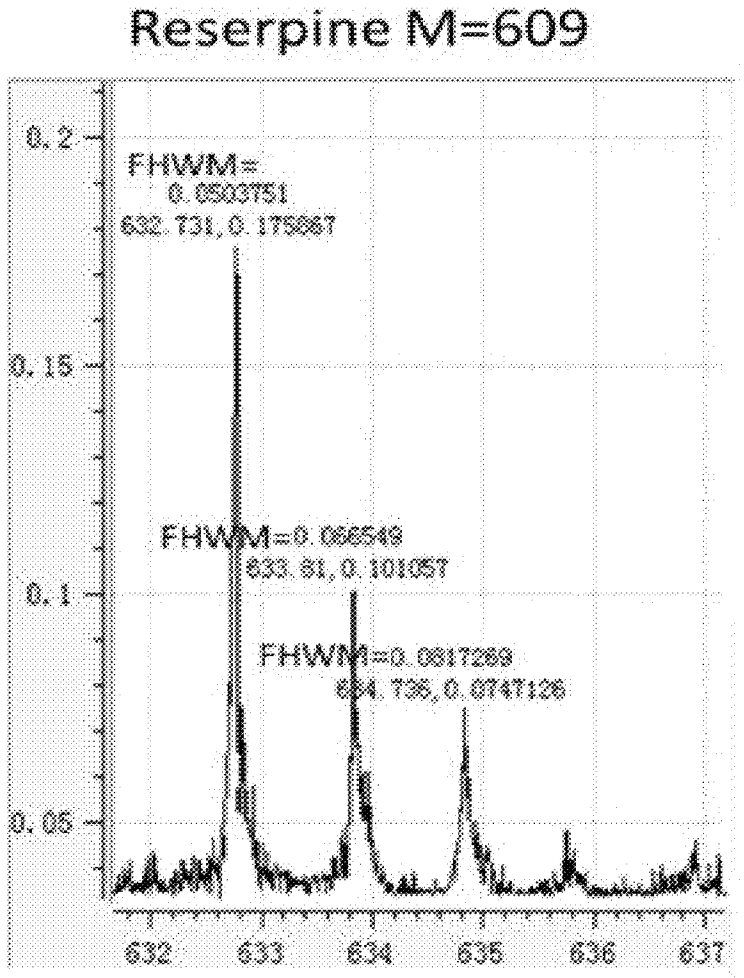
FIG. 10D is a high-resolution spectrogram formed by using reserpine as an analyte through RF modulation and quadrupole excitation waveforms formed by adopting a self-compensation method according to one embodiment of the present invention.

The above method proves that the RF amplitude modulation method has the potential possibility of higher resolution. A simpler modification solution is to modulate the RF signal by using only a 60 KHz RF modulation signal. Since this waveform can be regarded as a carrier signal, the low frequency part of the signal can be fed back and rectified out on the error amplifier fed back by the quadrupole power supply, so a 60 kHz waveform signal will also be generated. Usually, this signal is controlled to the output of the high-voltage DC generator circuit of the quadrupole power supply through a resistive divider, so this modulation can be correspondingly used as a quadrupole AC excitation waveform. By adjusting the ratio of the resistive divider, the formed RF modulation envelope waveform and quadrupole AC excitation waveform can be completely phase-aligned under an appropriate RF modulation voltage. By using this method, only a large RF modulation voltage is needed to produce a good X-band mass filter structure. FIG. 10D shows that, when the phase delay is well compensated under the voltage corresponding the mass number 609 of reserpine, the resolution of the main peak of reserpine can rise to the width of only 0.05 unit mass, while only ⅕ of signals under a unit mass resolution condition are attenuated when compared with the conventional mode. This result is even better than the result obtained by using a high-resolution and high-precision quadrupole mass analyzer with a larger field radius, such as 6 mm. Similar results can also be obtained for ions with other mass-charge ratios. However, due to the nonlinear relationship brought by this modulation and demodulation solution, an incomplete quadrupole excitation offset will be formed in the motion of ions in the Y-direction, and slight resolution attenuation will be caused, which is also shown in the front trailing characteristics of the mass spectrum peak pattern.

As shown in FIGS. 10A-10D, effects of high-resolution spectrograms formed for analytes with different mass numbers when RF modulation and quadrupole excitation waveforms are formed by adopting a self-compensation method are illustrated.

In the above device, the best X-band mass peak width is restricted to approximately 0.08. The reason for restricting higher resolution is that a higher RF modulation voltage such as higher than 0.25 V will produce asymmetric envelope waveforms in the current circuit. Although this phenomenon can hardly be learned in the signal displayed by an oscilloscope, it can be revealed by Fourier transform. In this case, the RF signal is different from the additional quadrupole AC waveform and cannot be fully compensated. In the next embodiment, we will show how to overcome this problem.

Embodiment 4

In this embodiment of the present invention, we further improve the system to overcome the influence of asymmetric quadrupole excitation waveforms caused by electronic restrictions.

Figure 11A:
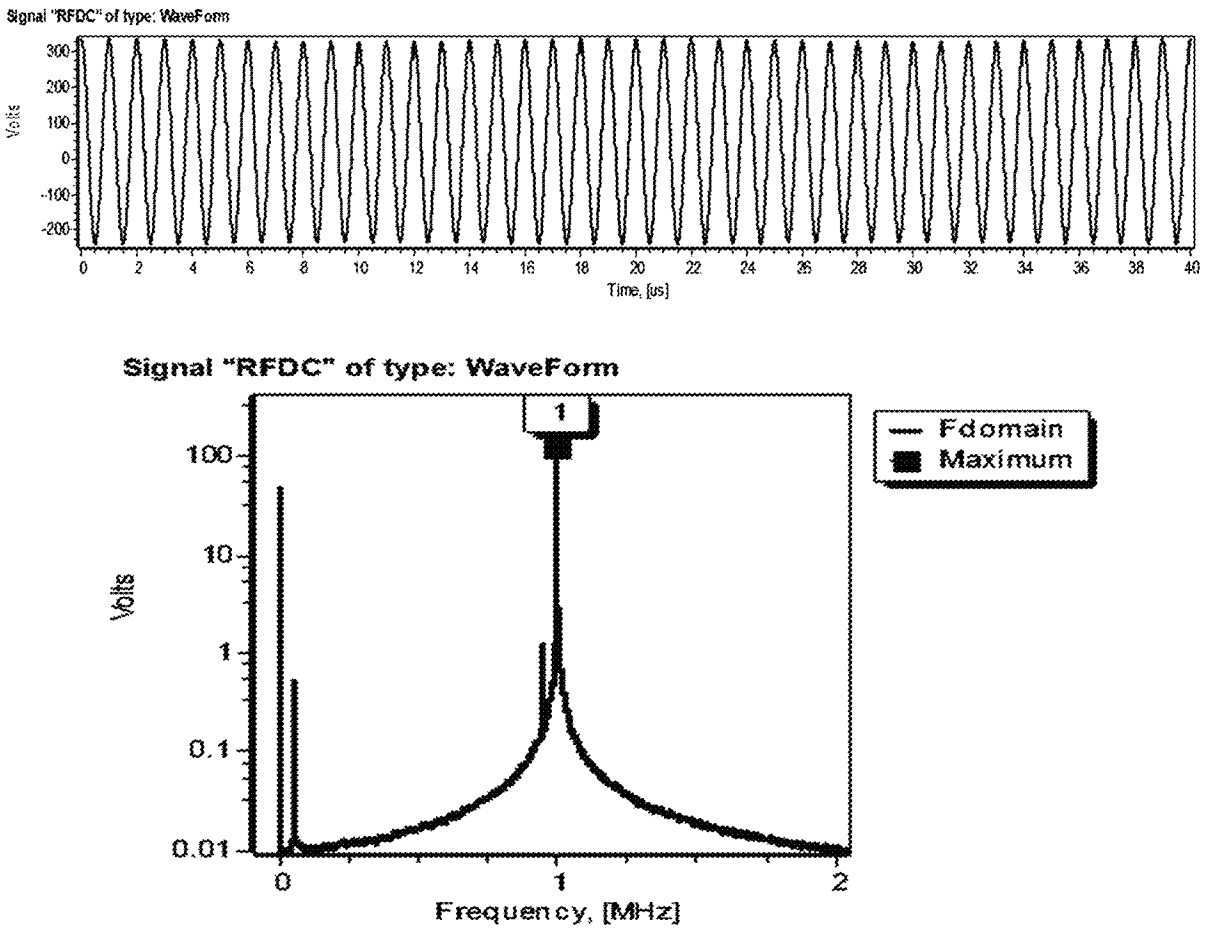
FIG. 11A is a waveform and frequency domain analysis diagram of an ideal waveform for generating an X-band according to one embodiment of the present invention.
Figure 11B:
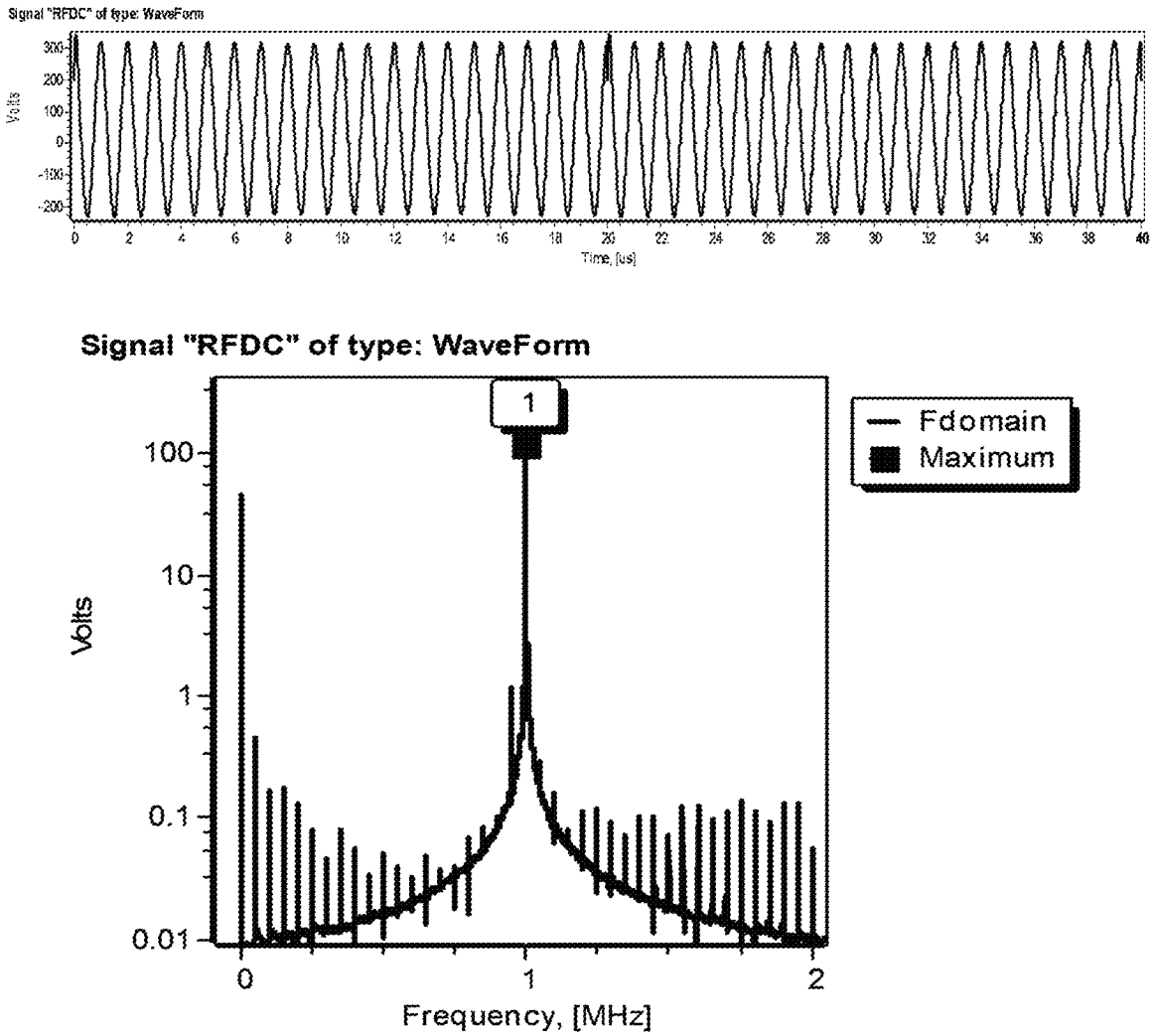
FIG. 11B is a waveform and frequency domain analysis diagram of an actual waveform for generating an X-band according to one embodiment of the present invention.

FIGS. 11A and 11B are waveform and frequency domain analysis comparison diagrams of an ideal waveform 121 and an actual waveform 122 for generating an X-band.

As shown in FIG. 11A, the waveform 121 shows a waveform that is theoretically inferred to form a perfect X-band. It can be found by Fourier transform that the main frequency of the waveform superimposed with amplitude modulation and accompanied by a proper reverse quadrupole excitation signal contains a quadrupole DC component which causes ion instability, a quadrupole excitation component with 1/n frequency division ratio and a high-frequency quadrupole AC component with 1-1/n frequency division ratio produced by amplitude modulation. If we observe carefully, we can also learn that there are very few of 2/n frequency divided signals. This is due to the high-order term produced by the prosthaphaeresis of the triangular function. However, to view from the amplitude, the power of the high-order components of the second or higher order is only 0.01 times or less of that of the first order. In the actual waveform, we can learn that the components of the 2/n frequency divided signal are increased obviously. At this moment, the signal will cause doubling of the ionic movement duration frequency in all directions in the sense of ion vibration. However, ½n frequency components are not correspondingly learned in this signal at high frequency bands. Therefore, the doubled-frequency motion of ions in the Y direction is not effectively offset, and an ideal Y-direction instability band cannot be suppressed at this moment.

Figure 12:
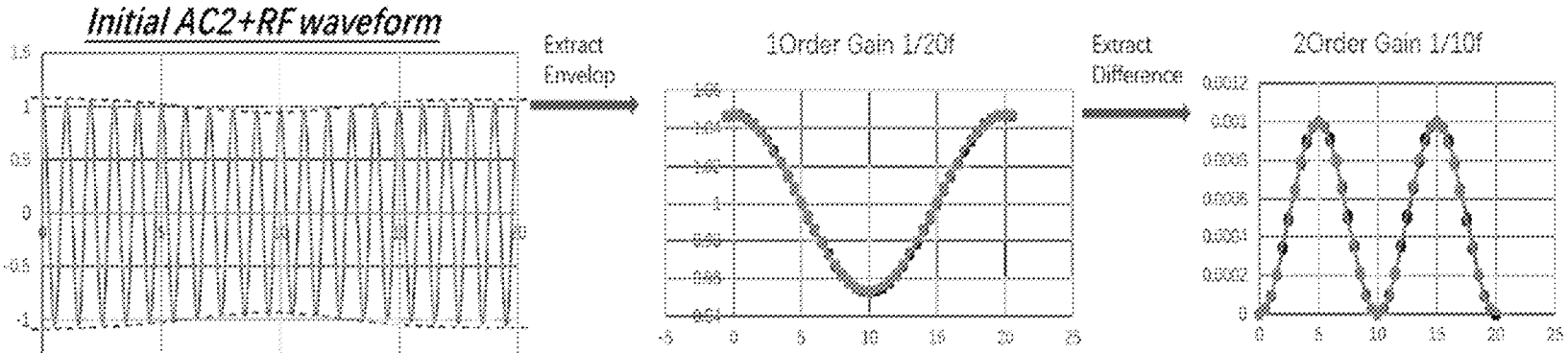
FIG. 12 is a schematic diagram of order analysis of a modulated RF signal for forming an X-band and required high-order frequency component intensity according to one embodiment of the present invention.

To resolve this problem, an ideal solution is to introduce an additional amplitude modulation signal with 2/n frequency division ratio, which can be learned through the analysis of the RF envelope band. Least-square fitting is performed to the pure RF signal superimposed with 1-1/n dividing frequency. As shown FIG. 12, the left figure illustrates a waveform data diagram of a modulation RF signal for forming an X-band based on a divide-by-20 frequency excitation signal, and order analysis of the envelope line is performed thereto. First, 1/n dividing frequency illustrated in the middle figure, i.e., the main waveform of the amplitude modulation signal corresponding to $\frac{1}{20}f_{RF}$ can be obtained. After deducting the amplitude modulation signal component of 1/n dividing frequency from this waveform, it can also be learned in the right figure that it further contains 2/n dividing frequency, i.e., an amplitude modulation signal corresponding to $\frac{1}{10}f_{RF}$.

Contrarily, if a 2/n dividing frequency term is introduced into the amplitude modulation signal, a motion frequency component of 1-2/n dividing frequency can also be formed in the spectrum of ion motion, and this component can be used for offsetting the original 2/n dividing frequency component formed by the electronic imperfection.

Similarly, this additional frequency component $\omega_{ex3}$ can also be designated as a positive value equal to $A\,\omega_{ex1}+B\Omega$, where A is a non-zero integer between −3 and 3, and B is a non-negative integer. These frequencies respectively correspond to the fundamental frequencies of the main RF voltage and quadrupole AC excitation voltage frequencies, and ion motion frequency characteristics caused by higher harmonics. The situation that the absolute values of A and B are 1 corresponds to fundamental frequency superimposition. If the quadrupole field type contains higher-order fields, such as an octupole field produced by symmetry breaking in the X-Y direction, or a hexapole field caused by single pole position offset, they respectively correspond to the situation that the absolute values of A and B are 2 and 3. By introducing an excitation voltage of a frequency component $\omega_{ex3}$ corresponding to these conditions, the clarity of the boundary of the formed stability band and the additional ion motion frequency component formed by the above waveform imperfection can be further corrected, and the resolution performance of the quadrupole mass spectrometry can be further improved.

Figure 13:
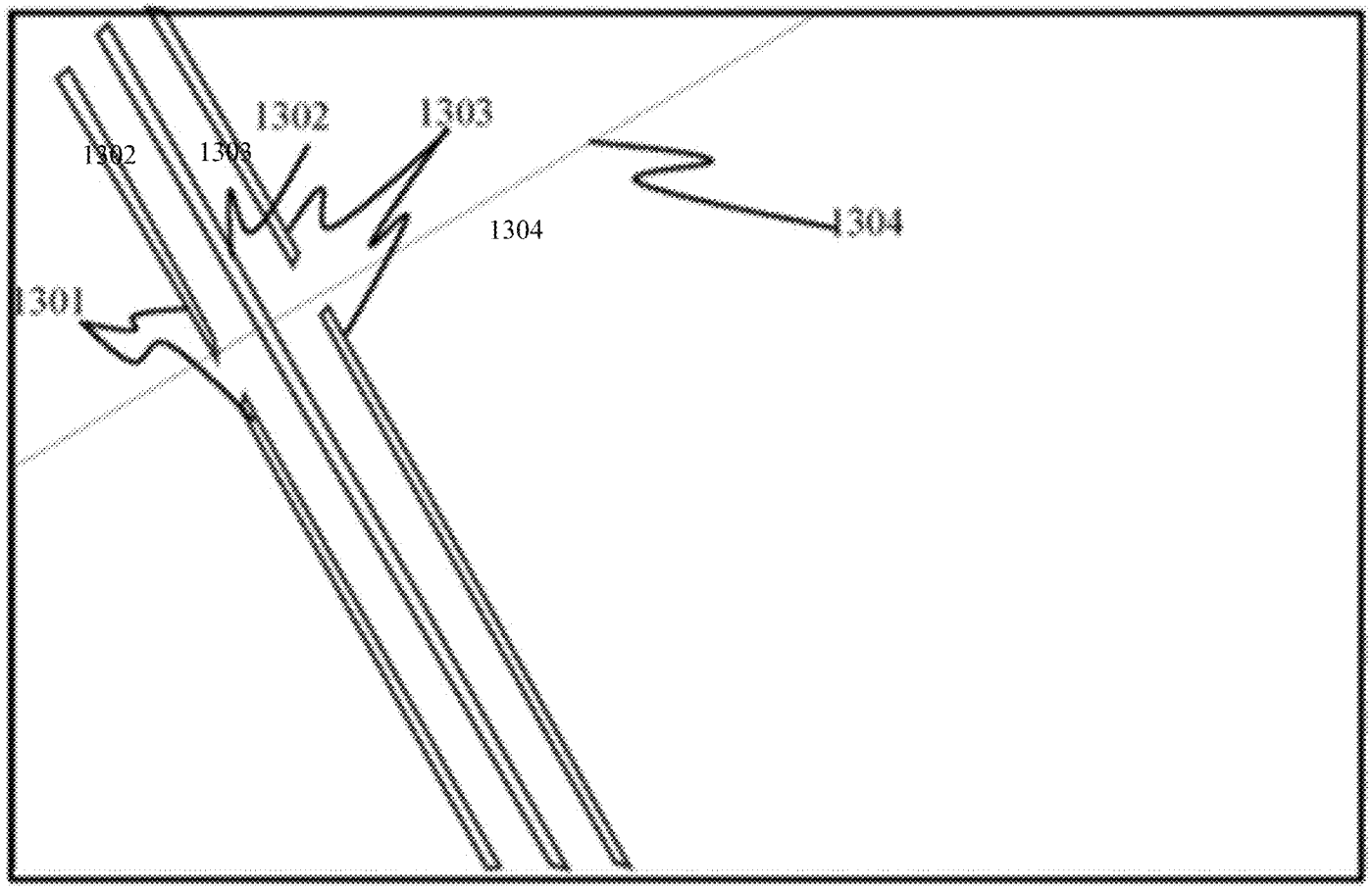
FIG. 13 is a schematic diagram for explaining an influence of unbalanced RF amplitude modulation on a quadrupole stability diagram according to one embodiment of the present invention.

Another method of improving the peak shape of the quadrupole is to deliberately introduce an RF amplitude modulation ratio which is greater or smaller than the balanced quadrupole excitation voltage condition in Table 2. FIG. 13 is used for explaining an influence of unbalanced RF amplitude modulation on a quadrupole stability diagram.

Herein, numeral references 1301, 1302 and 1303 are respectively X stability band shapes obtained at low, normal and high RF amplitude modulation ratios, and the RF amplitude modulation ratios AM2ratio are respectively 1.50, 1.5356 and 1.58. It can be learned that, when the RF amplitude modulation ratio applied to the quadrupole deviates from an ideal compensation value, the X stability band will be split, because of the ionic trajectory vibration influenced by RF modulation and the incomplete offset of the quadrupole excitation condition at the splitting position. The expansion of the trigonometric function product term in Mathieu equation 7.a/7.b formed by amplitude modulation will produce second-order and other higher-order additive terms, which will produce sharper lower edges of the splitting position. When the scanning line 1304 passes through these lower edges, the effective width of the actually formed X stability band becomes narrower. For example, when the RF amplitude modulation ratio is 1.50 and the slope of the scanning line is 0.1694, by cutting the lower edge of the split X stability band 1301, a mass resolution of 18,272 can be obtained for ions of reserpine with a mass of 609. When the same scanning line is used to pass through the fully compensated stability band 1302, the mass resolution is only 13,880. It can be learned that, when the RF modulation ratio and the higher-order frequency term of the effective quadrupole excitation voltage are reasonably configured, the mass resolution obtained by the method provided by the present invention is higher than that obtained by other prior methods of forming the stability band or island structure based on quadrupole excitation.

Embodiment 5

In the prior art, when a high-order stability region with a high q value is used, although a mass resolution of 14,000 can be obtained in the experimental report, since the sensitivity is too low, it is difficult to realize commercialization in the actual application. In the traditional mode, because of the existence of the edge field at the introducing end of the quadrupole, the ion loss in this method is too great. At the introducing end of the quadrupole, the contents of DC and RF are lower than that inside the quadrupole, and the ion motion becomes more instable. However, due to the existence of transverse motion, ions need to undergo very great ion sputtering to cross the edge field. In the quadrupole, the edge field exponentially decreases along the quadrupole and maintains $2r_0$ (the radius of the electric field of the quadrupole) in a distance. For a quadrupole with an electric field radius of 5 mm and a length of 200 mm, the edge field accounts for 5% of the total length. For ions which move for 100 RF periods, they will undergo five periods in the edge field, which will result in ion loss. In the traditional mode, the resolution is only 500 when the motion time is the same. To achieve a higher mass resolution, it is necessary to increase the ion motion time, and the time in the edge field will increase correspondingly, which will lead to the decrease of sensitivity. If an X-band is used at this moment, a high mass resolution can also be obtained even the motion time is 100 RF periods. Since the vertex of the stability region is only modified, compared with the traditional mode, the ion transmission efficiency will decrease.

Especially when a high resolution is required, the edge field brings a big problem. To overcome this problem, a DC delay technology was invented [W. M. Brubaker, D. Burnham, and G. Perkins, J. VAC. Sci. Technol, 8 (1971), 273-274].

Figure 14A:
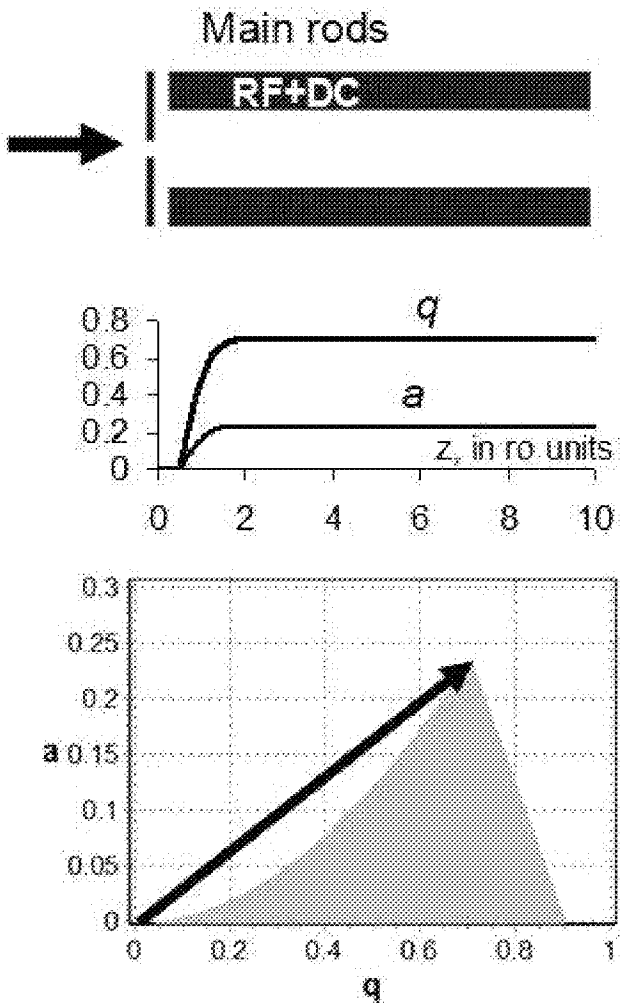
FIG. 14A is comparative schematic diagrams of a quadrupole structure containing no prerod structure, an edge field and an a-q stability diagram change in the prior art, where the upper part is a schematic structural diagram containing no quadrupole structure; the middle part is a schematic diagram showing changes along the axis and parameters through an edge field; the lower part illustrates changes of an a-q stability diagram represented by an arrow under the same parameters; and under the situation that the quadrupole has pre-parameters, the parameters in the stability region are always maintained.
Figure 14B:
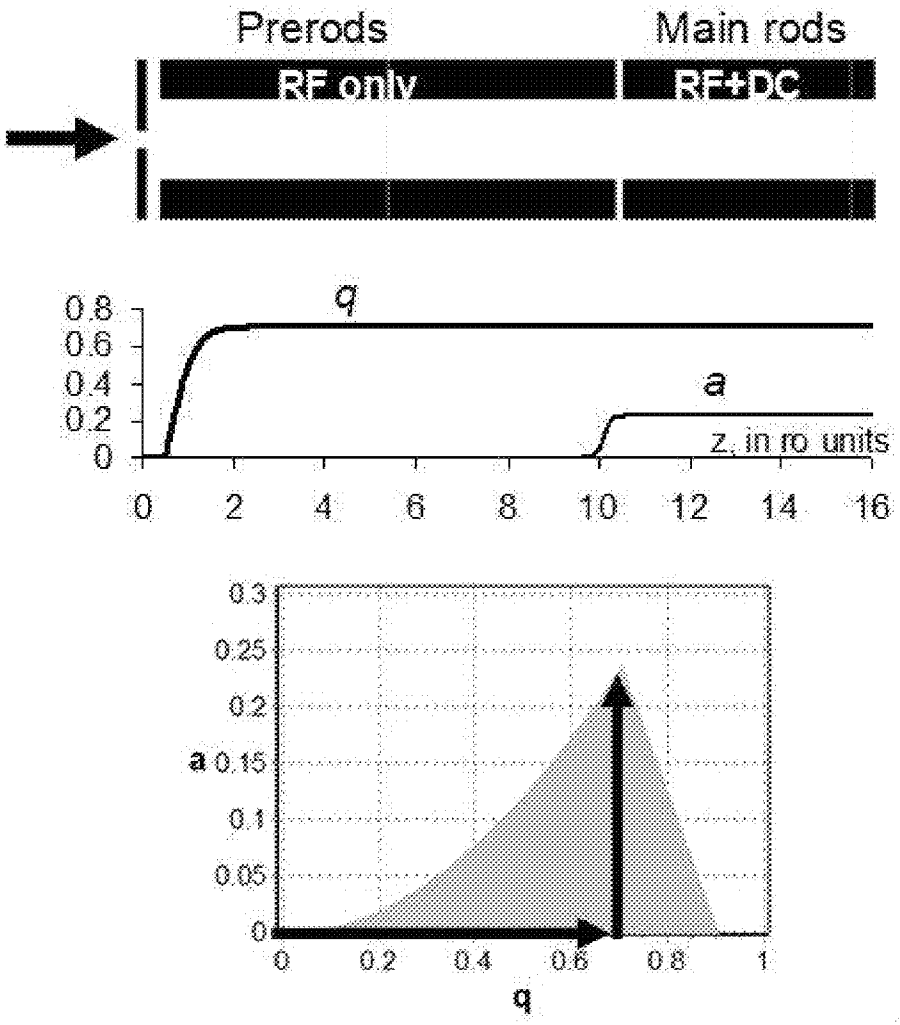
FIG. 14B is comparative schematic diagrams of a quadrupole structure in FIG. 14A improved by adopting a delayed DC slope technology, an edge field and an a-q stability diagram change in the prior art, where the upper part is a schematic structural diagram of a quadrupole containing a prerod structure; the middle part is a schematic diagram showing changes along the axis and parameters through an edge field; the lower part illustrates changes of an a-q stability diagram represented by an arrow under the same parameters; and under the situation that the quadrupole has pre-parameters, the parameters in the stability region are always maintained.

As shown in FIGS. 14A and 14B, the upper figure illustrates a schematic structural diagram during entering into a quadrupole, the middle figure illustrates corresponding changes during passing through edge fields a and q along a z axis of a quadrupole, and the bottom figure illustrates a change of the stability diagram represented by an arrow under the same parameters. In the drawings, it is supposed that the parameters in the quadrupole containing prerods are maintained consistent.

In this technology, a small section of rod (referred to as "prerod") is required to be additionally placed at the front end of the quadrupole. The main quadrupole has both RF voltage and DC voltage, but the prerod has only RF voltage. Therefore, there is no DC component when the ion beam enters the prerod. The edge field of the RF electric field of the prerod gradually increases from 0. Only when the ions enter the main quadrupole, the ions experience the electric field containing a DC component. Therefore, parameters a and q will be maintained stable in the first region, and the ion sputtering in the edge field will be minimized. This technology is shown in FIG. 8, from which it can be learned that, when ions enter the main quadrupole for analysis from the prerod region, the ions in the a, q parameter space first enter the deep position of the stability region due to the gradual enhancement of the edge RF quadrupole field, with the q value being increased, and then the ions in the gap between the prerod and the main rod finally reaches the top end of the stability region due to the enhancement of the edge DC quadrupole field, with the a value being increased, resulting in mass resolution. The ions in the whole process move in the stability diagram to avoid ion loss. However, in the case of using the prior X-band for ion mass separation, the difference between the effect of the X-band method and the effect of the traditional method using this improved method lies in that, when the ions move in front of the X-band which is very close to the vertex, the ions pass through a narrow instability band. At this moment, when the ions are located at the tail end of the edge field, i.e., the position where the prerod and the main rod are separated, if the experience time is long, serious ion beam scattering will be caused, resulting in ion loss.

Figure 15A:
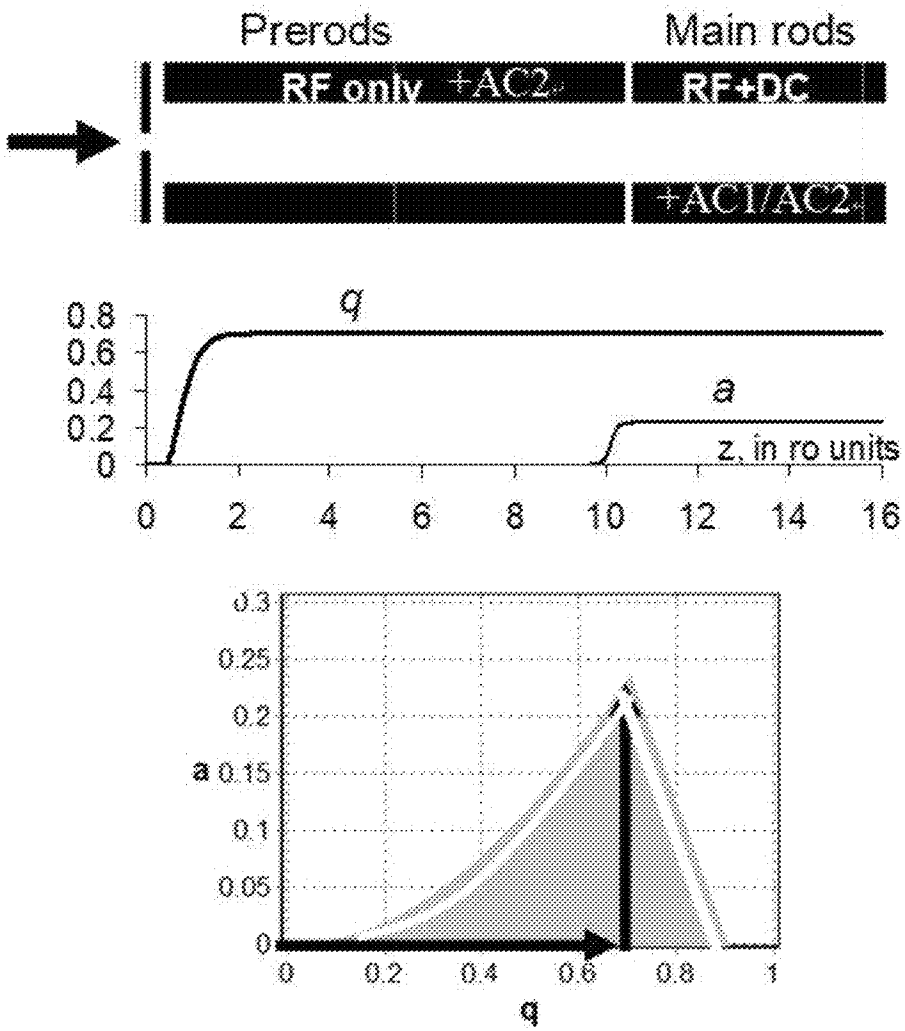
FIG. 15A is comparative schematic diagrams of a quadrupole structure in a solution of a quadrupole containing prerods provided by Miseki et al. in 1993, an edge field and an a-q stability diagram change in the prior art, where the upper part is a schematic structural diagram of a quadrupole containing prerods; the middle part is a schematic diagram showing changes along the axis and parameters through an edge field; the lower part illustrates changes of an a-q stability diagram represented by an arrow under the same parameters; and in the drawing, it is supposed that the parameters in the quadrupole containing prerods are maintained consistent.
Figure 15B:
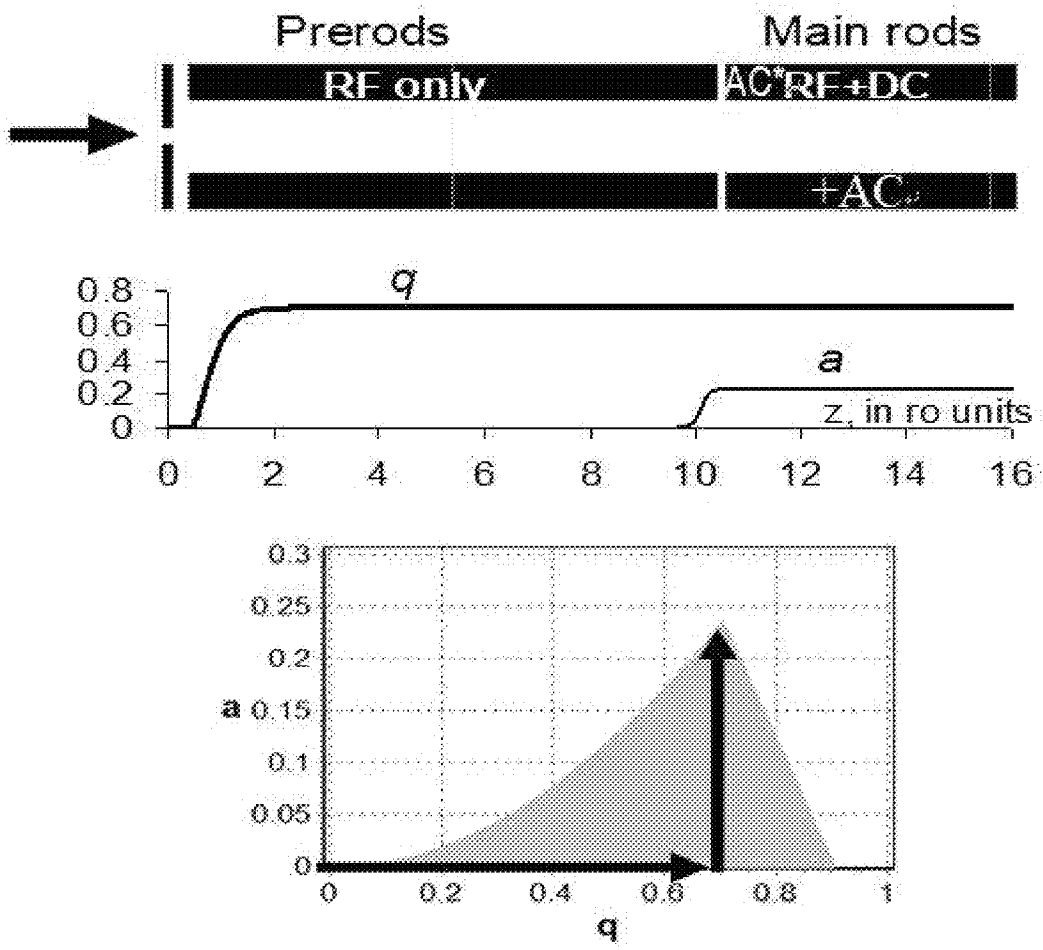
FIG. 15B is comparative schematic diagrams of a quadrupole structure with prerod structure ion passing rate improved by modulating the amplitude of an RF voltage, an edge field and an a-q stability diagram change according to one embodiment of the present invention, where the upper part is a schematic structural diagram of a quadrupole containing prerods; the middle part is a schematic diagram showing changes along the axis and parameters through an edge field; the lower part illustrates changes of an a-q stability diagram represented by an arrow under the same parameters; and in the drawing, it is supposed that the parameters in the quadrupole containing prerods are maintained consistent.

FIGS. 15A and 15B are used for comparatively describing the improvement of the ion pass rate of the prerod structure through RF voltage amplitude modulation in the present invention.

As shown in FIG. 15A or 15B, the upper figure illustrates a schematic structural diagram during enter into a quadrupole, the middle figure illustrates a change during passing through edge fields a and q along a z axis of a quadrupole, the bottom figure illustrates a change of the stability diagram represented by an arrow under the same parameters. In the drawings, it is supposed that the parameters in the quadrupole containing prerods are maintained consistent.

In the previous patent solution of X-band separation, since RF and two excitation voltage signals having a frequency division relationship of 1/n and 1-1/n are applied to the quadrupole, when the AC signal of the main rod is additionally applied to the prerod through a capacitance network, since the 1-1/n high-frequency AC excitation voltage signal (AC2) is very similar to the initial RF signal, it is difficult to avoid coupling it to the prerod.

At this moment, the stability diagram structure of ions in the prerod is restored to the stability island structure proposed by Miseki et al. in 1993, as shown in the lower figure of FIG. 15A. When ions pass through the instability band between islands, the ions will be scattered and a part of the pass rate will be lost.

However, in the present solution, since the frequencies of the RF amplitude modulation signal and the quadrupole excitation signal are only a fraction of the main RF frequency, the AC excitation signal on the prerod can be isolated through a simple band-pass filter (such as RC network). At this moment, the stability region structure formed when ions pass through the prerod is illustrated in the lower figure of FIG. 15B, and the ion beam in the instability band between the stability islands is prevented from being diverged.

Figure 3:
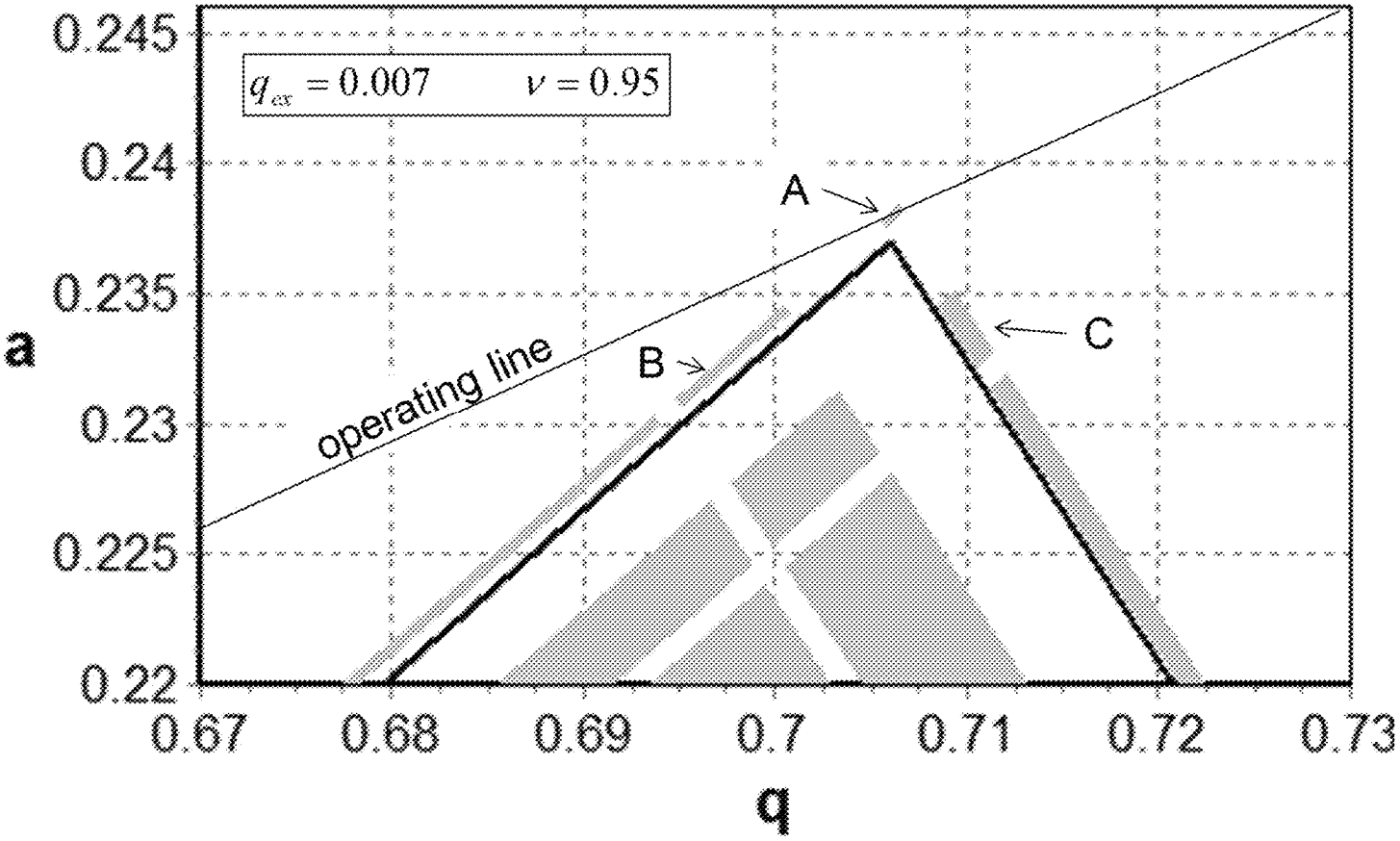
FIG. 3 is a schematic diagram of stability islands, i.e., stability regions (grey), in the background under the influence of single AC excitation at the main RF frequency of 0.95, where the three main stability regions are marked as A, B and C; the boundary of the initial stability region is represented by a wide solid line, and the oblique operating line is represented by a thin solid line.

Using the modulation method to form the X-band for ion separation has another significant advantage that the vibration amplitude of the ions is only changed in the X-direction. As mentioned above, near the X-band, the Y-direction motion of ions along the scanning line is maintained stable. In the traditional mode, the scanning line sweeps through the vertex of the stability region, and the q value of the side with a low mass number is high, and instable motion will be caused in the X direction. At the same time, instable motion will be caused on the side with a high mass number in the Y direction. Considering that the sensitivity of a mass spectrometer is determined by the initial position of ions, the initial energy distribution and the time of transmission to the detector, the requirement for ions which can pass through the quadrupole mass analyzer stably is that the motion of the ions in any X or Y direction at any moment is required to be smaller than $r_0\Omega^2$. From FIG. 3, it can be learned that this is also related to the ion separation of the stability island A. However, due to the instable motion of the ions in the X and Y directions, the ion transmission loss is too great, so the application of the traditional mode is restricted in practice. Comparatively, the restriction in the use of the X-band is only in one direction, i.e., X direction, while the motion in the Y direction is stable. In the prior art such as in the solution of Alan Schoen, two dipole excited electric fields are needed to form a pass-band, which will destroy the symmetry of the electric field. The solution of Sudakov et al. needs a high-frequency AC excitation signal, which is difficult to be generated and decoupled from the main RF signal, so it will lead to signal distortion to influence ion transmission. As described above, with the application of the AC excitation voltage and the RF amplitude modulation signal, a stability band can appear, and fast ion mass separation can also be realized. When the low-frequency AC excitation voltage is used, it only takes several periods to enable the instable ions to hit the quadrupole and disappear. In the traditional mode, more than 100 RF periods are needed, and there is also the influence caused by the non-linear field distortion. The use of stability islands will avoid such influence. The characteristics of the stability band formed by applying two AC excitation voltages according to the present invention are also described herein.

To sum up, according to the present invention, by using the stability band for scanning, the mass resolution of the quadrupole can be significantly improved, and there is no significant ion transmission loss. The reasons are as follows:

1) The ion mass separation is faster. By using the low-frequency AC excitation voltage, it takes only a few of periods to enable the instable ions to hit the quadrupole and disappear. In addition, a mass resolution of more than 10,000 can be obtained.

2) The ion mass separation only occurs in one direction, which improves the sensitivity.

3) The instability band for ion mass separation only appears near the apex of the first stability region, so the DC delay technique can be used to improve the sensitivity.

4) Both the RF amplitude modulation signal and the AC excitation voltage can be low-frequency signals with frequencies which are several times to tens of times less than the frequency of the main RF signal, so it is easy to decouple the generation and regulation from the initial RF control circuit, which is conducive to the realization of the stability of the system.

5) No additional high-frequency AC excitation voltage is required, and it is not influenced by the non-linear field distortion of the edge of the analytic rod.

The above embodiments and calculation results in the present invention are all implemented under the situation of a frequency v=0.05, which more conforms to reality, i.e., there are five low-frequency excitation periods in 100 RF periods. This process is also relatively easy to realize experimentally, because divide-by-2, divide-by-5 and divide-by-10 frequency dividers with low phase noise can be commercially purposed, and the cost of using this device to form a mass filter band is relatively low. In fact, similar amplitude modulation mass filter bands can also be obtained by adopting other frequency division parameters.

Also as shown in Table 1, when the frequency values are all in a range of 0 to 0.2, under the situation that the ratio of the excitation voltage amplitudes is equal, the results are similar. As described above, the quadrupole can use the values of the AC excitation voltage and the modulation amplitude in Table 2. In actual application, other means may also be introduced to apply more than two AC excitation voltages, such as by adding a third AC excitation voltage, or improving the RF power supply to combine with the AC excitation voltage. Such improvements should be considered as technical solutions derived from the present invention and are hereby declared.

The above embodiments are only used for exemplarily describing the principles and effects of the present invention, instead of limiting the present invention. Any person skilled in the art may modify or change the above embodiments without departing from the spirit and scope of the present invention. Therefore, all equivalent modifications or changes made by a person skilled in the art without departing from the spirit and technical thought disclosed by the present invention shall still be covered by the claims of the present invention.

Some references, which may include patents, patent applications and various publications, are cited in a reference list and discussed in the description of this invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference.

What is claimed is:

1. A quadrupole mass analyzer, comprising:

a first pair of rod electrodes placed in a first plane along an axial direction;

a second pair of rod electrodes placed in a second plane along an axial direction, the second plane being perpendicular to the first plane so that the first pair of rod electrodes and the second pair of rod electrodes form a quadrupole;

a DC power supply configured for providing a DC potential difference U between the two pairs of rod electrodes;

an RF power supply configured for providing an RF voltage between the two pairs of rod electrodes, an amplitude of the RF voltage being V and a frequency being 0;

a first AC frequency source configured for driving a first AC excitation voltage between the two pairs of rod electrodes, an amplitude of the first AC excitation voltage being smaller than the amplitude V of the RF voltage and being recorded as $V_{ex1}$, a frequency of the first AC frequency source being $\omega_{ex1}$ different from $\Omega$; and a second AC frequency source configured for linearly modulating the amplitude V of the RF voltage, at a modulation frequency being $\omega_{ex2}$.

2. The quadrupole mass analyzer of claim 1, wherein $\omega_{ex1}$ is equal to $\omega_{ex2}$.

3. The quadrupole mass analyzer of claim 1, wherein $\omega_{ex1}$ is twice $\omega_{ex2}$.

4. The quadrupole mass analyzer of claim 1, wherein $V_{ex1}/V$ is in a range of 0.001 to 0.02.

5. The quadrupole mass analyzer of claim 1, wherein $\Omega/\omega_{ex1}$ is an integer greater than or equal to 5.

6. The quadrupole mass analyzer of claim 1, wherein a modulation depth of the second AC frequency source to the RF voltage provided by the RF power supply is in a range of 90% to 110%.

7. The quadrupole mass analyzer of claim 1, wherein a modulation depth of the second AC frequency source to the RF voltage provided by the RF power supply maintains a linear relationship with an amplitude $V_{ex1}$ of an excitation voltage generated by the first AC frequency source.

8. The quadrupole mass analyzer of claim 1, wherein the quadrupole mass analyzer comprises a third AC frequency source configured for driving a second AC excitation voltage between two pairs of rod electrodes, an amplitude of the second AC excitation voltage is smaller than the amplitude V of the RF voltage and is recorded as $V_{ex3}$, and the frequency $\omega_{ex3}$ is different from $\Omega$.

9. The quadrupole mass analyzer of claim 8, wherein $\omega_{ex3}$ is equal to a positive value of $A\,\omega_{ex1}+B\Omega$, wherein A is a non-zero integer between −3 and 3, and B is a non-negative integer.

10. The quadrupole mass analyzer of claim 1, wherein a ratio of U to V is in a range of 0.167 to 0.172.

11. A method of mass analysis, applied to the quadrupole mass analyzer of claim 1, comprising:

guiding ions to enter the quadrupole mass analyzer along an axial direction, wherein in the quadrupole mass analyzer, the RF power supply applies an RF voltage with the amplitude of V and the frequency of $\Omega$ between the two pairs of rod electrodes, and the DC power supply applies the DC potential difference U between the two pairs of rod electrodes; the first AC frequency source applies the first AC excitation voltage with the amplitude of $V_{ex1}$ and the frequency of $\omega_{ex1}$ between the two pairs of rod electrodes, and the first AC excitation voltage is superimposed on the RF voltage; the second AC frequency source generates a modulation signal with a modulation frequency of $\omega_{ex2}$, and modulates the amplitude V of the RF voltage by using the signal;

maintaining a specific ratio among the amplitude of the RF voltage, the voltage amplitude of the first AC frequency source and the modulation amplitude of the second AC frequency source, so that the AC frequency sources are phase-coherent; and regulating the amplitude of the RF voltage to collect ions.

* * * * *